United States Patent [19]

Torregrossa et al.

[11] 4,298,426

[45] Nov. 3, 1981

[54] METHOD AND APPARATUS FOR TREATING PULP WITH OXYGEN IN A MULTI-STAGE BLEACHING SEQUENCE

[75] Inventors: Louis O. Torregrossa, Puyallup; Jozef M. Bentvelzen, Sumner; Gerald D. Crosby, Seattle; Michael D. Meredith, Federal Way, all of Wash.; Henry Bepple, Kamloops, Canada

[73] Assignee: Weyerhaeuser Company, Tacoma, Wash.

[21] Appl. No.: 48,936

[22] Filed: Jun. 15, 1979

[51] Int. Cl.[3] ..... D21C 9/12; D21C 9/14; D21C 9/16; D21D 5/28

[52] U.S. Cl. ..... 162/57; 162/65; 162/66; 162/67; 162/78; 162/243

[58] Field of Search ..... 162/65, 57, 24, 243, 162/60, 66, 67, 88, 89, 90, 23, 78, 63; 8/109, 156, 149.1; 366/102, 103, 104, 157, 167, 178, 303; 68/5 B, 5 C, 5 D, 181 R, 183

[56] References Cited

U.S. PATENT DOCUMENTS

| | | | |
|---|---|---|---|
| 3,293,117 | 12/1966 | Pennington | 162/243 |
| 3,769,152 | 10/1973 | Samuelson et al. | 162/65 |
| 4,023,737 | 3/1976 | Leider et al. | 241/261.3 |
| 4,039,154 | 8/1977 | Peterson | 241/261.3 |
| 4,082,233 | 4/1978 | Reinhall | 162/24 X |
| 4,093,506 | 6/1978 | Richter | 162/65 |

OTHER PUBLICATIONS

"The Asplund RL 50 S Raffinator", Defibrator, Oct. 1971.

"Rauma Repola Double Shaft Mixer", Bulletin (no data available).

"The Present and Future Role of Oxygen Bleaching", Jamieson.

Kleppe et al., "Oxygen/alkali Delignification at Kumy Digester Blowline Consistency", *TAPPI*, vol. 59, No. 11, Nov. 1976.

Kirschner et al., "Low Consistency Oxygen Delignification in a Pipeline Reactor—Pilot Study".

"The Bleaching of Pulp", TAPPI Monograph Series, No. 27, 1963.

*Primary Examiner*—S. Leon Bashore

*Assistant Examiner*—Steve Alvo

[57] ABSTRACT

A wood pulp slurry is treated with oxygen in a mill with little change to the process or structure of the mill. No special pressure tanks are required. The consistency of the pulp need not be altered for the treatment step. It may be treated at the usual process consistency of the pulp; e.g., it may be treated at the usual consistency of the pulp leaving a washer or subsequent steam mixer without additional dewatering or additional dilution.

The oxygen is added into a closed section of the system so that it cannot immediately vent to the atmosphere. Alkali should also be present when the oxygen is mixed with the slurry. The mixing should occur near to the point of oxygen addition.

The mixing occurs in a relatively small mixer that intensively mixes the slurry and gas. The mixer has a mixing zone with a swept area of 10,000 to 1,000,000 square meters per metric ton of oven-dry pulp. A preferred range is 25,000 to 150,000 square meters per metric ton of oven-dry pulp and an optimum range of around 65,400 square meters per metric ton of oven-dry pulp.

The pulp is treated several times during a sequence. Some sequences are O-X-O and O-O-X-O in which X may be chlorine, chlorine dioxide, a combination of chlorine and chlorine dioxide - mixture of chlorine and chlorine dioxide, $C_D$, $D_c$ -, hypochlorite, peroxide and ozone. The sequence may be followed by a D stage.

Other systems and specific mixer designs are also disclosed.

79 Claims, 36 Drawing Figures

601
602
603
604
605
590''
33
33

605
604

581
590
591
592
594
593
595

580'
581'
27
582'
551'
583'
558
590'
27
590'
556

25
580
581
590
26
590
582
556
551
583
584
25
26

551
583
580
581
582
556
590

METHOD AND APPARATUS FOR TREATING PULP WITH OXYGEN IN A MULTI-STAGE BLEACHING SEQUENCE

BACKGROUND OF THE INVENTION

1. Field of the Invention

Apparatus and process for treating wood pulp with oxygen.

2. Review of the Prior Art

The following definitions will be used in this application.

Pulping is the changing of wood chips or other wood particulate matter to fibrous form. Chemical pulping requires cooking of the chips in solution with a chemical, and includes partial removal of the coloring matter such as lignin associated with the wood.

Bleaching is the treatment of cellulosic fibers to remove or alter the coloring matter associated with the fibers to allow the fiber to reflect white light more truly.

The standard symbols for pulping and bleaching sequences are:

S=Sulfite
K=Kraft
So=Soda
C=Chlorine
H=Sodium or calcium hypochlorite
E=Alkali extraction, usually with sodium hydroxide
D=Chlorine dioxide
P=Alkaline peroxide
O=Oxygen
A=Acid pretreatment or post treatment Consistency is the amount of pulp fiber in a slurry, expressed as a percentage of the total weight of the oven dry fiber and the solvent, usually water. It is sometimes called pulp concentration.

The consistency of the pulp will depend upon the type of dewatering equipment used. The following definitions are based on those found in Rydholm *Pulping Processes,* Interscience Publishers, 1965, pages 862–863 and TAPPI Monograph No. 27, *The Bleaching of Pulp,* Rapson editor, The Technical Association of Pulp and Paper Industry, 1963, pages 186–187.

Low consistency is from 0–6%, usually between 3 and 5%. It is a suspension that is pumpable in an ordinary centrifugal pump and is obtainable using deckers and filters without press rolls.

Medium consistency is between 6 to 20%. Fifteen percent is a dividing point within the medium-consistency range. Below 15% the consistency can be obtained by filters. This is the consistency of the pulp mat leaving the vacuum drum filters in the brownstock washing system and the bleaching system. The consistency of a slurry from a washer, either a brownstock washer or a bleaching stage washer, is 9–13%. Above 15%, press rolls are needed for dewatering. Rydholm states that the usual range for medium consistency is 10–18%, while Rapson states it is 9–15%. The slurry is pumpable by special machinery even though it is still a coherent liquid phase at higher temperatures and under some compression.

High consistency is from 20–40%. Rydholm states that the usual range is 25–35% and Rapson states that the range is from 20–35%. These consistencies are obtainable only by presses. The liquid phase is completely absorbed by the fibers, and the pulp can be pumped only very short distances. For practical purposes, it is non-pumpable.

Pulp quantity is expressed in several ways.

Oven dry pulp is considered to be moisture free or bone dry. Its value is determined by drying the pulp in an oven at a temperature of 100° to 105° C. until it reaches constant weight. It usually is considered to have reached constant weight after 24 hours in the oven.

Air dry pulp is assumed to have a ten percent moisture content. One air-dry ton of pulp is equal to 0.9 oven-dry tons of pulp.

It also may be helpful in the understanding of the prior art to describe a typical pulp mill and relate the prior art oxygen bleaching systems as well as the present invention to this typical mill.

FIG. 1A–1C is a diagram of a typical pulp mill. In the mill the means of transporting chips or pulp from one operation to another will depend upon the consistency of the pulp and the location of the equipment. The transportation means may be a conveyor or a chute if the consistency is too high for the pulp or chips to be pumped, or a pipe if the pulp is capable of being pumped.

Chips 10, process water 11, steam 12 and pulping chemicals 13 are placed in a digester 14. The wood chips 10 may be treated prior to entering the digester 14. This is optional. Exemplary of such treatment are presteaming of the chips in a steaming vessel or impregnation of the chips with the digestion chemicals in an impregnation vessel prior to entering the digester. The chemicals 13 will depend on the process being used, be it sulfate, sulfite, or soda, and the digester 14 may either be batch or continuous in operation. A continuous digester is shown. The chips will be cooked under appropriate conditions within the digester. These conditions, which depend on the species of chip and the type of pulping used, are well known.

The products of the digestion process are the delignified or partially delignified wood chips, the spent pulping chemicals, and the lignin and carbohydrate products which have been removed from the wood chips in the digestion process. The treatment of the chips, after cooking, will depend in part on the type of digester being used. A major portion of the spent pulping chemicals and lignin products are removed from the chips prior to further processing. In the continuous digester shown, the chips are washed in the washing section of the digester. This is indicated by process water 15 entering and effluent stream 16 leaving the washing stage of digester 14. The effluent 16 will consist of the lignin and carbohydrates which have been removed from the chips during the digestion process and the spent digestion chemicals. This effluent will be carried to a treating facility. In the case of kraft or sulfate pulp this would be a recovery system in which the liquor is burned to recover the digestion chemicals for reuse.

This washing would not take place in a batch digester. In a batch system, all the washing would occur in the following brownstock washing system.

Following this treatment, the chips will pass from the digester 14 through the blow line to storage or blow tank 22. It is customary in pulp mills to have storage tanks between separate processes so that the entire mill will not shut down if one section of the mill is shut down. Storage tank 22 is one such tank. It would be between the digester stage and the subsequent washing or bleaching stages. The storage tank 22 is open to the atmosphere and so is at atmospheric pressure.

Tank 22 may be a diffusion washer instead of a storage tank. Diffusion washers are described in Rydholm *Pulping Processes,* Interscience Publishers, 1965, pages 725–730 and illustrated in FIG. 10.14 on page 728. The diffusion washer would be followed by a storage tank.

The material passing through the blow line is a slurry which contains the remaining lignin and carbohydrates, the spent digestion chemicals, and the fibers formed from the chips as they are blown from the digester. The chips will be formed into fibers when the pressure on the chips is partially released, usually at the outlet of digester 14. The slurry will still be under some pressure to move it through the blow line. If the digester is continuous, then additional fiberizing may be done by a refiner, or refiners, in the blow line. The refiners will fiberize the large particles that have not been reduced to fibers earlier in the process. In the present diagram, two refiners—18 and 19—are shown. In the two-refiner system, the first refiner 18 does course refining and the second refiner 19 does fine refining. The refiners are optional. They are usually encountered in a linerboard mill. The digester in a bleached pulp mill normally would not have refiners in the blow line. Neither would they be used with a batch digester.

The blow line is shown in three sections—section 17 between the digester 14 and refiner 18; section 20 between the refiners 18 and 19; and section 21 between the refiner 19 and the storage tank 22.

From the storage tank 22 the fibers and liquor are carried by pump 23 through line 24 to the washers and screens. The system will be described by following the pulp through the system, and then following the wash water through the system.

The pulp slurry is first carried to the brownstock washers 28 where the rest of the lignin and chemicals are removed from the fibers. Four washers are shown. This is the number that would normally be used with a batch digester. The washing section in a continuous digester would replace the first two brownstock washers. Each of these washers is usually a vacuum or pressure drum washer or vacuum or pressure drum filter and the operation of each is the same. The operation of a vacuum or pressure drum washer will be described. Some of the washers may, however, be diffusion washers. In a diffusion washer, the pulp slurry would not be diluted prior to entering the washer.

The pulp slurry from line 24 enters the vat 30 of washer 31. The vacuum drum 32 revolves through the vat, and the vacuum pulls the fibers in the slurry onto the outer surface of the filter drum and holds the fibers, in mat form, against the surface while pulling the liquor or filtrate through the filter cloth to the interior piping of the vacuum drum to be discharged as effluent. The revolving drum carries the fiber mat from the vat past a bank of washer heads that spray a weak filtrate onto the mat to displace the liquor from the mat. The vacuum also pulls this displaced liquid into the interior piping of the drum. The consistency of the mat leaving a washer, either the brownstock washers described here or the bleach washers described later, will usually be between 8 to 15%.

The pulp mat 33 is removed from the face of the drum 32 by a doctor blade, carrier wires or strings between the drum and the mat, rolls or any other standard manner and carried to the vat 50 of the second brownstock washer 51. Again, the fibers are picked up on vacuum drum 52. The pulp mat 53 is washed with still weaker filtrate, removed from the vacuum drum 52 and carried to the vat 70 of brownstock washer 71. The operation of this washer is the same as the others, the vacuum drum being 72 and the mat 73. The mat 73 is carried to the vat 90 of the last brownstock washer 91. Again, the operation of this washer is the same as the others, the vacuum drum being 92 and the mat 93.

From the brownstock washers the pulp mat 93 is carried to storage tank 110 with the aid of thick stock pump 96. In the lower section of tank 110, the pulp is diluted and then carried through line 111 by pump 112 to screens 113 in which the larger fiber bundles and knots are removed. The bundles and knots 114 are carried to further treatment by suitable transportation means.

The pulp 115 is carried from the screens 113 to the vat 120 of decker 121 in which additional water is removed. The operation of the decker is similar to that of the washers. Washing showers may or may not be used in the decker. The vacuum drum is 122 and the pulp mat is 123. The pulp 123 is carried by thick stock pump 126 to a high-density storage tank 140 in which it is stored until it is bleached.

The liquor or filtrate from the vat 120 and the mat 123 flows through piping which extends radially from the vacuum chambers at the surface of the vacuum drum 122 to a pipe in the central shaft of the rotating drum. This liquor or filtrate passes through the central pipe and an external line 128 to a filtrate storage tank or seal tank 129. The tank 129 is called both a storage tank and a seal tank because it acts both to store the filtrate for further use and to seal the vacuum drum 122 from the outside atmosphere to maintain the lower pressure of the vacuum system within the drum.

The filtrate from tank 129 may be handled in several ways. Several of the uses may occur simultaneously. Although the following description is specific to the effluent from tank 129, it is also illustrative of how the effluent from any of the washers in brownstock washing system 28 would be handled.

First, the filtrate from tank 129 is reused to reduce the consistency of the pulp slurry either entering the decker 121, entering the screens 113 or leaving storage tank 110. Line 130 carries the filtrate to lines 131, 133 and 135. Line 131 and pump 132 carry the filtrate back to screened pulp 115 to reduce the consistency of the pulp slurry entering vat 120 to around 1½%. Line 133 and pump 134 carry the filtrate back to line 111 to reduce the consistency of the pulp slurry entering the screens 113 to from 0.2 to 2%. Line 135 and pump 136 carry the filtrate back to storage tank 110 to reduce the consistency of the pulp slurry leaving the tank to around 5%.

Second, the filtrate not reused for dilution may be taken to an effluent treatment system by line 130 and effluent line 29. This treatment may include combining the effluent with the effluent in line 16, or carrying the effluent directly to the cooking liquor recovery system. It should be understood that in a batch digester system the digester effluent is recovered completely from the brownstock washing system while in a continuous digestion system only a portion of the digester effluent would be recovered from the brownstock washers.

All of the remaining filtrate would be handled as effluent if counterflow washing, to be described next, is not used. Some of the filtrate may be handled as effluent even if counterflow washing is used.

Third, the filtrate from tank 129 may be used as wash water in the brownstock washing system 28 in a counterflow washing system. In this system, the filtrate flow is counter to the flow of pulp. The line 137 and pump 138 carry the filtrate back to brownstock washer 91 for use as wash water. The filtrate is sprayed on the pulp mat by washer heads 95 and displaces the liquor within the mat. This filtrate may also be sprayed on the carrier wires, strings or rolls after the pulp mat is separated from them to remove any pulp fibers that cling to the wires, strings or rolls if water instead of air is used for this operation. This is done by cleanup washer 94. Additional water may be required to supplement the filtrate. This is provided through process water line 97.

The flow of filtrate through brownstock washer 91 is the same as the flow through decker 121. The liquor, either from the mat or the vat, is carried through internal piping to line 98 and through line 98 to filtrate storage tank or seal tank 99. Again, the filtrate from the seal tank 99 may be handled in a number of ways. Line 100 would carry it to effluent line 29. Line 101 and pump 102 would carry the filtrate to pulp 73 to reduce the consistency of the pulp slurry to 1½% to 3½% as it enters vat 90. Line 103 and pump 104 would carry the filtrate to brownstock washer 71 to be used as wash water.

The process in brownstock washers 71, 51 and 31 are, for the most part, identical to the process in brownstock washer 91 so the parts are similarly numbered. The washer heads are 75, 55 and 35 respectively. The cleanup washers are 74, 54 and 34 respectively. The filtrate lines are 78, 58 and 38 and the filtrate storage or seal tanks are 79, 59 and 39. The filtrate lines from the seal tanks to effluent line 29 are 80, 60 and 40.

The consistency of the slurry entering any of the vats 70, 50 or 30 should be 1½% to 3½%. The lines and pumps carrying the filtrate to the pulp to reduce the consistency of the slurry entering a vat are 81 and 82, 61 and 62, and 41 and 42, respectively. The counterflow wash water lines and pumps are 83 and 84, and 63 and 64.

In brownstock washer 31, line 43 and pump 44 carry the filtrate into storage tank 22 to reduce the consistency of the pulp slurry in the bottom of the tank to 2 to 3½% before it exits the tank.

In each of the brownstock washers, there is a possibility that additional process water may be needed to supplement the filtrate being used as wash water. Lines 77, 57 and 37 are for this purpose. These lines would provide all the wash water to the individual washers if the counterflow system described above is not used and parallel flow washing is used instead.

The washed pulp which has passed through the brownstock washing system 28, the screens 113 and decker 121 remains in storage tank 140 until it is carried into the bleaching system.

The bleaching process in FIG. 1 will also be described by following the pulp stream through the bleaching system from washed pulp to bleached pulp and then by following the wash water from its entry into the process through to bleach plant effluent. The particular bleaching sequence illustrated is $D_c$EDED. The process conditions are taken from the TAPPI monograph *The Bleaching of Pulp* noted earlier.

There are many other bleaching sequences which could be used. Listings of these sequences may be found in the standard texts. As a rule, the first stage is chlorine and subsequent stages use chlorine dioxide, hydrogen peroxide, or a hypochlorite. These stages are interspersed with alkali extraction stages.

The pulp stored in high-density tank 140 normally is at a consistency of approximately 9 to 15%. This pulp slurry is carried from tank 140 through line 141 to tank 146 by pump 142. The pulp in line 141 is diluted with additional water or filtrate to a consistency of around 5%. In mixer 144 in line 141, the slurry is mixed with chlorine dioxide from line 145 as the D step of the first stage $D_c$ bleach. If the first stage is to be chlorine alone, then this step would be omitted. The treated dilute slurry enters storage tank 146 in which the chlorine dioxide reacts with the unbleached pulp. The size of this tank will depend upon the amount of pulp being treated and the time of the chlorine dioxide treatment. The time of this initial treatment normally is one to five minutes. The slurry exits the tank into line 150 and is treated with chlorine.

Chlorine from line 151 and process water from line 152 are mixed in aspirator 153 and the diluted chlorine flows through line 154 to mixer 155 in which the chlorine is mixed with the dilute pulp slurry in line 150. The treated slurry is moved by pump 156 through line 150B into chlorine bleaching tower 157. The tower 157 is sized to allow the chlorine to react with the extraneous matter in the unbleached pulp. This retention or reaction time will depend, in part, on the water temperature. At minimum temperature, the TAPPI monograph suggests a retention time of about 45 to 60 minutes for sulfite pulp, and 60 to 90 minutes for kraft pulps. The treated slurry exits tank 157 and is carried through line 158 by pump 159.

The slurry in line 158 is combined with additional water or filtrate to reduce the consistency to about 1 to 1½%. This dilute slurry flows into vat 160 of washer 161. Again a vacuum drum washer or filter is shown. The operation of this washer is the same as that of the brownstock washers. The vacuum drum 162 revolves through the vat. The vacuum pulls the fibers in the slurry onto the outer filter surface of the drum and holds them against the surface, forming a mat, while pulling the liquid or filtrate through the filter cloth to the interior piping of the vacuum system in the drum to be discharged as effluent. The revolving drum 162 carries the fiber mat from the vat past a bank of washer heads which spray water or weak filtrate onto the mat to displace reaction products and unreacted chlorine entrained in the mat.

The pulp mat 163 is removed from the face of drum 162. The means of removal is the same as in the brownstock washers—a doctor blade, carrier wires or strings between the drum and the mat, rolls or in any other standard manner. The pulp mat 163 is moved to mixer 166. This movement usually is by gravity fall through a chute from the washer to the mixer.

Prior to leaving washer 161, the pulp mat 163 is impregnated with the caustic or alkali extraction solution from line 167. A sodium hydroxide solution is usually used. The alkali solution is applied to the mat just as it is leaving the vacuum drum 162 so that the solution will penetrate the pulp mat but not be carried through the mat into the washer effluent. The amount of alkali added, expressed as sodium hydroxide, will be 0.5 to 7% of the oven-dry weight of the pulp. The alkali may be added to the pulp in the steam mixer 166 instead of at the washer 161.

In steam mixer 166 the treated mat is mixed with steam from line 168 to raise the temperature of the pulp to approximately 62° C. The heated slurry is carried through line 169 into extraction tower 173 by high-density pump 170. In some cases transfer to the extraction tower is by gravity. The extraction tower may be downflow or upflow. The high-density pump 170 for either an upflow or a downflow tower may be at the base of the tower. The pulp would then be carried to the top of a downflow tower by an external line. The location of the pump in the plant is a matter of convenience. Support of the pump and access to the pump for maintenance are primary considerations. The slurry remains in tower 173 to allow the extraction solution to react with and extract the chlorinated materials from the pulp. This time may be one to two hours.

Before leaving the extraction tower, the pulp slurry is mixed with water or filtrate in dilution zone 174 to reduce its consistency to approximately 5%. The slurry is carried by line 175 and pump 176 from dilution zone 174 to the vat 180 of washer 181. Washer 181 is shown and described as a vacuum or pressure drum washer but it may be a diffusion washer. During its passage through line 175, the slurry is further diluted with water or filtrate until its consistency is approximately 1 to 1½% when it reaches the vat 180. The operation of washer 181 is identical to that of washer 161. The fibers are picked up on the revolving drum 182, washed and removed as pulp mat 183.

The pulp is then moved to steam mixer 186 of the chlorine dioxide stage. This transfer may again be be gravity drop through a chute. Prior to leaving washer 181, the mat 183 is treated with a slight amount of alkali from line 187. A sodium hydroxide solution is usually used. It is added to the mat at a point on the drum which will allow the solution to stay in the mat and not pass into the filtrate. The purpose of this treatment is not further extraction but adjustment of the pH of the pulp prior to being treated with chlorine dioxide. The pH of the pulp should be in the range of 5 to 7, preferably 6, for optimum brightness when bleaching with chlorine dioxide. The alkali may be added in the steam mixer 186 instead of the washer 181.

In steam mixer 186 the pulp 183 is mixed with steam from line 188. The pulp will have a consistency of approximately 1% less than from the washer when it leaves a steam mixer.

The pulp leaves steam mixer 186 and is carried through line 189 by pump 190 to mixer 191 which it is combined with chlorine dioxide from line 192. It then enters chlorine dioxide tower 193. This tower usually is an upflowdownflow tower. The pulp remains in the tower long enough to allow the chlorine dioxide to react with it. The reaction is about complete after one hour but normally continues for up to four hours. Consequently, the retention time in the tower is usually four hours. Prior to leaving the tower, the slurry is diluted to a consistency of about 5% in dilution zone 194. It is also treated with a small amount of sulfur dioxide or alkali from line 197. The sulfur dioxide or alkali reacts with any excess chlorine dioxide so there will be no free chlorine dioxide emanating from the washer or the pulp leaving the washer.

This diluted slurry is then carried by line 195 and pump 196 to vat 200 of washer 201. During its passage through line 195, the slurry is again diluted to a consistency of about 1 to 1½% when it reaches vat 200, and again treated with additional sulfur dioxide from line 198. The pulp is picked up on vacuum drum 202, and the reaction products and unreacted bleaching chemicals washed from it prior to being removed as pulp mat 203.

This pulp is moved to the steam mixer 206 of the second extraction stage, usually by gravity drop through a chute. Again, sodium hydroxide from line 207 is added on washer 201 or at the mixer 206, and in mixer 206 the treated pulp mat 203 is mixed with steam from line 208. This slurry is then carried through line 209 by pump 210 to extraction tower 213. The conditions in this extraction stage are the same as those in the first extraction stage. The tower may be downflow or upflow.

After the appropriate dwell time, the pulp enters dilution zone 214, and its consistency is reduced to approximately 5%. The pulp is then carried through line 215 by pump 216 to the vat 220 of washer 221. Washer 221 is also shown and described as a vacuum or pressure drum washer but it may be a diffusion washer. Again, it is diluted to a consistency of about 1 to 1½% before entering the vat. The slurry is picked up by vacuum drum 222 and washed and discharged as pulp mat 223. If necessary, the pH of the pulp may be adjusted by treating the mat with sodium hydroxide from line 227. This may occur on the drum 222 or in the steam mixer 226.

The pulp enters the last chlorine dioxide stage. The conditions and flow in this stage are the same as in the first chlorine dioxide stage. The pulp is dropped into or carried to steam mixer 226, and mixed with steam from line 228. The slurry is carried through line 229 by pump 230 to mixer 231, mixed with chlorine dioxide from line 232 and carried into the chlorine dioxide tower 233, shown as an upflow-downflow tower, where it remains for one to four hours. The pulp then enters dilution zone 234 where its consistency is reduced to about 5%. It is also treated with a small amount of sulfur dioxide from line 237 to remove any excess chlorine dioxide.

The slurry is carried from dilution zone 234 through line 235 by pump 236. During its travel through line 235, the pulp is again treated with additional sulfur dioxide or alkali from line 238 to remove any free chlorine dioxide and is further diluted so that the slurry is at a consistency of about 1 to 1½% when it reaches vat 240 of washer 241. It is picked up by vacuum drum 242, washed and discharged from the bleaching system as bleached pulp 243.

Pulp from the mat usually adheres to the wire or strings carrying the pulp mat from the washer and it is necessary to wash these fibers from the wires or strings into the vat prior to their contacting new fibers. This may be done by cleanup washer 164 on washer 161, cleanup washer 184 on washer 181, cleanup washer 204 on washer 201, cleanup washer 224 on washer 221, and cleanup washer 244 on washer 241. Air may also be used.

The passage of liquid through the washer is the same as in the brownstock washers. Wash water is sprayed onto the mat by the washer heads. This water displaces the entrained liquid within the pulp mat on the drum. The displaced liquid is carried through piping internally of the rotating vacuum drum to a pipe in the central shaft of the drum. Here, it is combined with the liquor being pulled into the drum from the washer vat. This combined liquor passes outwardly through a central pipe in the drum and an external line to a seal or storage tank which maintains the vacuum in the drum by providing a seal between the vacuum inside the drum and the ambient pressure externally of the drum.

In washer 161, process water from washer heads 251 passes into the central shaft of vacuum drum 162, and outwardly through external line 252 to seal or storage tank 253. In washer 181, the washer heads are 271, the external line is 272 and the seal or storage tank is 273. In washer 201, the washer heads are 291, the external line is 292, and the seal or storage tank is 293. In washer 221, the washer heads are 311, the external line is 312, and the seal or storage tank is 313, and in washer 241 the washer heads are 331, the external line is 332, and the seal or storage tank is 333.

The routes taken by the filtrate after it leaves the seal or storage tank are also the same as those in the brownstock washers.

First, the filtrate is used to dilute the slurry within the washing stage or a tower.

For example, the filtrate would dilute the pulp slurry being carried to the vat. The filtrate from the seal tank 253 of the chlorine stage washer 161 would be carried by line 255 and pump 256 into line 158 to be used to dilute the pulp slurry going to vat 160. In the same way, line 275 and pump 276, and line 277 and pump 278, carry the filtrate from the seal tank 273 of the first extraction stage washer 181 into line 175 to dilute the slurry going to vat 180; line 295 and pump 296, and line 297 and pump 298, carry the filtrate from the seal tank 293 of the first chlorine dioxide stage washer 201 into line 195 to dilute the slurry going to vat 200; line 315 and pump 316, and line 317 and pump 318, carry the filtrate from the seal tank 313 of the second extraction stage washer 221 into line 215 to dilute the slurry going to vat 220; and line 335 and pump 336, and line 337 and pump 338, carry the filtrate from the seal tank 333 of the second chlorine dioxide washer 241 into line 235 to dilute the slurry going to vat 240.

In the chlorine stage, line 259 and pump 260 also carry the filtrate to line 141 to dilute the pulp from highdensity storage.

In the extraction and chlorine dioxide stages, the filtrate is also supplied to dilute the slurry in the dilution zone of the tower in the stage. In the first extraction stage, the filtrate from seal tank 273 is carried into the dilution zone 174 by line 281 and pump 282. In the first chlorine dioxide stage, line 301 and pump 302 carry the filtrate from the seal tank 293 into the dilution zone 194. In the second extraction stage, line 321 and pump 322 carry the filtrate from the seal tank 313 into dilution zone 214, and in the second chlorine dioxide stage line 341 and pump 342 carry the effluent from the seal tank 333 into dilution zone 234.

Second, the filtrate not reused for dilution is discharged as effluent or to further processing as by line 254 from tank 253, line 274 from tank 273, line 294 from tank 293, line 314 from tank 313, and line 334 from tank 333. The effluent from the chlorine stage washer 161 is separate from the effluent from the other washers because of its high chlorine or salt content and its larger content of residual material. The other lines—274, 294, 314 and 324—discharge into effluent line 350.

All of the remaining filtrate would be handled as effluent if counterflow washing is not used. Some of the filtrate may be handled as effluent even if counterflow washing is used.

In the counterflow washing system shown, the wash water for the second chlorine dioxide washer 241 is process water from line 330; the wash water for the second extraction washer 221 is partly or wholly filtrate from the second chlorine dioxide washer 241 which is supplied from seal tank 333 by line 343 and pump 344; the wash water for the first chlorine dioxide washer 201 is partly or wholly filtrate from the second extraction washer 221 which is supplied from seal tank 313 by line 323 and pump 324; the wash water for the first extraction washer 181 is partly or wholly filtrate from the first chlorine dioxide washer 201 which is supplied from seal tank 293 by line 303 and pump 304; and the wash water for the chlorine washer 161 is partly or wholly filtrate from the first extraction washer 181 which is supplied from seal tank 273 by line 283 and pump 284. Any additional wash water would be supplied through lines 250, 270, 290 and 310. These lines would provide all the wash water to the individual washers if the counterflow system is not used and parallel flow washing is used instead.

The chemical, water and steam supplies to the system are shown in the upper section of FIG. 1. Process water is carried through line 360 to the various lines supplying water to the process, line 351 to the digester lines 11 and 15, lines 37, 57, 77 and 97 to the brownstock washers 28, line 152 to the chlorine aspirator 153, and lines 250, 270, 290, 310 and 330 to the bleach system washers. Chlorine is supplied through line 361 to line 151. Alkali line 362 supplies dilute alkali to lines 167, 187, 207 and 227. It is normally a 5–10% solution before entering line 362. Chlorine dioxide line 363 supplies a chlorine dioxide solution to lines 145, 192 and 232. Steam is supplied through line 364 to steam lines 12, 168, 188, 208 and 228. Sulfur dioxide is supplied to lines 197, 198, 237 and 238 from line 365.

Methods of measuring the practically and efficiency of a pulping or a bleaching process are the pulp yield, the physical properties of the pulp, the degree of pulp delignification, the pulp brightness, and the cost of obtaining the pulp.

Yield may be measured in two ways. The first is the amount, by weight, of carbohydrates and lignin returned per unit of wood. Screened yield is closely related and proportional to this chemical return. A high screened yield means the chemical return is high and a low screened yield means the chemical return is low. The second measurement of yield is fiber yield, by weight, per unit of wood. Rejects or screenings are related to and inversely proportional to the fiber yield. A high reject level means there is a low fiber return and a low reject level means there is a high fiber return. The total yield is the sum of these two yields. The ideal situation would be one in which there is a high chemical return and a high fiber return indicated by a high screened yield and low screenings.

The physical properties are freeness, burst, tear, fold, breaking length, density, and viscosity. Pulp samples are beaten in a PFI machine either for a specified number of revolutions and the freeness determined, or to a specified freeness and the time to freeness determined. The freeness of the pulp, Canadian Standard Freeness (CSF), is determined by TAPPI Standard T 227 M-58, revised August 1958. The beaten pulp is tested for burst, tear, fold, breaking length, and density. Burst is a numerical value obtained by dividing the burst strength in grams per square centimeter by the basis weight of the sheet in grams per square meter and is determined by TAPPI Standard Test T 220 M-60, the 1960 Revised Tentative Standard. This test is also used to determine tear. Tear is a numerical value and equals 100 e/r in which e is the force in grams to tear a single sheet, and r is the weight of the sheet per unit area in grams per square meter. Fold, breaking length in meters and density in grams per cubic centimeter are determined by TAPPI Standard Test T 220 OS-71. Pulp viscosity is in centipoises and is determined by TAPPI Standard Method T-230 SU-66.

There are two principal types of measurements to determine the completeness of the pulping or bleaching process, the degree of delignification and the brightness of the pulp. There appears to be no correlation between the two because the delignification factor is a measure of residual lignin within the pulp and the brightness is a measure of reflectivity of the pulp sheet.

There are many methods of measuring the degree of delignification of the pulp but most are variations of the permanganate test.

The normal permanganate test provides a permanganate or K number—the number of cubic centimeters of tenth normal potassium permanganate solution consumed by one gram of oven dry pulp under specified conditions. It is determined by TAPPI Standard Test T-214.

The Kappa number is similar to the permanganate number but is measured under carefully controlled conditions and corrected to be the equivalent of a 50% consumption of the permanganate solution in contact with the specimen. The test gives the degree of delignification of pulps through a wider range of delignification than does the permanganate number. It is determined by TAPPI Standard Test T-236.

PBC is also a permanganate test. The test is as follows:

1. Slurry about 5 hand-squeezed grams of pulp stock in a 600-milliliter beaker and remove all shives.
2. Form a hand sheet in a 12.5-centimeter Buckner funnel, washing with an additional 500 milliliters of water. Remove the filter paper from the pulp.
3. Dry the hand sheet for 5 minutes at 99° to 104° C.
4. Remove the hand sheet and weigh 0.426 grams of it. The operation should be done in a constant time of about 45 seconds to ensure the moisture will be constant, since the dry pulp absorbs more moisture.
5. Slurry the weighed pulp sample in a 1-liter beaker containing 700 milliliters of 25° C. tap water.
6. Add 25 milliliters of 4 N sulphuric acid and then 25 milliliters of 0.1000 N potassium permanganate. Start the timer at the start of the permanganate addition.
7. Stop the reaction after exactly 5 minutes by adding 10 milliliters of the 5% potassium iodide solution.
8. Titrate with 0.1000 N sodium thiosulfate. Add a starch indicator near the end of the titration when the solution becomes straw color. The end point is when the blue color disappears.

In running the test, the thiosulfate should first be added as rapidly as possible to prevent the liberation of free iodine. During the final part of the titration the thiosulfate is added a drop at a time until the blue color just disappears. The titration should be completed as rapidly as possible to prevent reversion of the solution from occurring.

The PBC number represents the pounds of chlorine needed to completely bleach one hundred pounds of air dried pulp at 20° C. in a single theoretical bleaching stage and is equal to the number of milliliters of potassium pemanganate consumed as determined by subtracting the number of milliliters of thiosulfate consumed from the number of milliliters of potassium permanganate added.

Many variables affect the test, but the most important are the sample weight, the reaction temperature and the reaction time.

There are also a number of methods of measuring pulp brightness. It usually is a measure of reflectivity and its value is expressed as a percent of some scale. A standard method is GE brightness which is expressed as a percentage of a maximum GE brightness as determined by TAPPI Standard Method TPD-103.

Another measure of the brightness or delignification is the opacity of the fiber. Opacity as a percent of a standard is determined by TAPPI Standard Test T 425 OS-75.

The cost of a pulping process is measured both by capital cost and operating chemical cost, the capital cost being the cost of the plant and facilities and the operating cost being the ongoing process costs of chemicals, raw materials and labor.

The capital costs of a mill are high because large vessels are required for holding the chips or pulp during each of the lengthy processing steps. For example, *The Bleaching of Pulp* states that the reaction times for a chlorine bleaching step is 45 to 90 minutes, for a hypochlorite bleaching step 1 to 8 hours, for a chlorine dioxide bleaching step 1 to 4 hours, and for an extraction step 1 to 2 hours. The size of a tower will depend upon the retention time, the rate of production, the effective tower volume, the consistency, the degree of packing, and the uniformity of the pulp flow. Rydholm, noted earlier, indicates that the space demand for one ton of pulp in a vessel will vary from 3 to 15 cubic meters, depending upon the consistency and degree of packing. He suggests a minimum of 7.5 cubic meters per ton of pulp and states that 7–8 cubic meters per tone of pulp is normal for medium-consistency operation. This probably is on an air-dry weight basis, the usual basis in the mill.

With this as background, we can now see how researchers attempted to add oxygen into the pulping and bleaching process, or to replace portions of the system with oxygen processing. A continuing concern was the poor solubility of oxygen in water and its poor transference from the gas to the liquid phase and into the fiber. The usual solutions to these problems have been high pressures, high oxygen concentrations, high pulp consistencies or particular vessel configurations to promote the transfer of oxygen into the fiber.

Several patents and articles describe bleaching sequences using oxygen.

Jamieson "The Present and Future Role of Oxygen Bleaching," undated, discloses a number of sequences using oxygen. These include $C_DOD$, COD, OCED, $OC_DOD$, ODEDED and $OC_DEDED$.

Rerolle et al. U.S. Pat. No. 3,423,282 describe sequences having a central OC sequence. These are OCE, OCP and $OCH_{(in\ situ)}$. The C stage is reduced from 1 hour to 15 minutes and the amount of chlorine is reduced to 50–70% of the normal amount used.

Smith et al. U.S. Pat. No. 3,725,194 notes $O_2$CEDED, $SO_2$-$O_2$-$SO_2$-DED, $So_2$-$O_2$-H-DED, and $SO_2$-$O_2$-DED sequences.

Grigorescu "Oxygen Bleaching of Fibrous Pulps" Celuloza Si Hirtie 23 (2), 58–62 (1974) describes AODED, COD, CODED and OCDED sequences.

Jamieson et al. "Mill Scale Applications of Oxygen Bleaching in Scandinavia" 1973 TAPPI Alkaline Bleaching Pulping Conference, 231–238, lists a number of sequences. These are O, OP, OH, OD, ODED, COD, OCED, OC/DED, CODED, OC/DEHD, OCEDED, OC/DEDED, OHD, OPHD, OHPD, OC/DPD, OC/$DE_H$D, and OC.

Jamieson et al. "Advances in Oxygen Bleaching" TAPPI, 11/71, 54, No. 11, 1903–1908 compares OC and CO sequences.

Soteland "Bleaching of Chemical Pulp with Oxygen and Ozone," *Pulp and Paper Magazine of Canada,* Vol. 75, No. 4, April 1974, pp. 91–96 mentions a number of sequences which include oxygen and high-consistency ozone treatments. These are oxygen-ozone, oxygen-ozone-peroxide, oxygen-ozone-hypochlorite, oxygen-ozone-ozone-peroxide, and oxygen-ozone-ozone-hypochlorite.

Rothenburg, et al. "Bleaching of Oxygen Pulps with Ozone," TAPPI, Vol. 58, No. 8, August 1975, pp. 182–185 describes oxygen-ozone, oxygen-ozone-sodium hydroxide extraction -ozone, oxygen-ozone-peroxide and oxygen-ozone-acetic acid sequences. The ozone treatment is high consistency in each of these sequences.

Kirk et al. "Low Consistency Oxygen Delignification in a Pipeline Reactor—Pilot Study," 1977 TAPPI Alkaline Pulping/Secondary Fibers Conference, Washington, D.C., November 7–10, 1977, describes a pipeline reactor in which pulp at a 3% consistency is bleached with oxygen using a waterfull system. Oxygen is introduced incrementally. In Table 2, Kappa numbers were measured at 15 minutes and 30 minutes. FIG. 4 is a graph of a Kappa number reduction versus time. Kappa numbers were measured at 3, 5, 10, 15, 20 and 30 minutes after oxygen addition.

The Rauma-Repola system is described in the Federal Republic of Germany Pat. No. 24 41 579, Mar. 13, 1975 in the Yrjala et al, New Aspects in Oxygen Bleaching, dated Apr. 18, 1974. The system uses the Vortex mixer shown in FIGS. 2 and 3 of the patent. It is possible, by using either a number of passes through a single mixer or several mixers in series, to bleach the pulp in from 5 to 15 minutes. The consistency is 3%.

Yrjala et al. "A new reactor for pulp bleaching" Kemian Teollisuus 29, No. 12: 861–869 (1972) describes a chlorine reactor.

Richter U.S. Pat. No. 4,093,506, issued June 6, 1978, describes a mixer for mixing bleaching fluids such as chlorine or chlorine dioxide with a high-consistency pulp. Rapidly rotating rotor blades essentially fluidize the pulp and the treatment gas is then added to it. The Kamyr reator is also described in an article, "Pilot and Commercial Results of Medium Consistency Chlorination," given at the Bleaching Seminar on Chlorination and Caustic Extraction, Nov. 10, 1977 in Washington, D.C.

The TAPPI monograph "The Bleaching of Pulp" describes and shows on pp. 325 and 332, respectively, single-shaft and double-shaft steam mixers. A steam mixer has a swept area of around 6500 square meters per metric ton of ovendry pulp.

Reinhall U.S. Pat. No. 4,082,233, issued Apr. 4, 1978, discloses a refiner having means for removing excess gas before the stock enters the refiner.

SUMMARY OF THE INVENTION

The usual oxygen systems require a capital investment of several million dollars because of the large vessels employed. The high-consistency systems require complex machinery to fluff the pulp prior to oxygen treatment. It limits the oxygen treatment to a single stage.

The inventors decided to investigate both the need for costly expenditures and for lengthy times in which to do oxygen bleaching. They decided to add oxygen to an existing system and determine the results. They found, contrary to prior art teaching, that the oxygen may be added to the pulp and processed at the consistency at which the pulp normally comes from the washer or subsequent steam mixer, that much of the treatment occurs in less than a minute in the mixer and a majority occurs in the mixer and its outlet line, and that a long reaction time or large capital-intensive equipment is not required for oxygen treatment. What is required is relatively small mixing equipment which intensively mixes the pulp and the gas.

Several desirable sequences are possible. These are O-X-O and O-O-X-O in which X is C, D, a combination of C and D- a mixture of C and D, $C_D$, $D_c$-, H, P or ozone. The sequence may be followed by a D step.

The mixing occurs in a relatively small mixer that intensively mixes the slurry and gas. The mixer has a mixing zone with a swept area of 10,000 to 1,000,000 square meters per metric ton of oven-dry pulp. A preferred range is 25,000 to 150,000 square meters per metric ton of oven-dry pulp and an optimum range of around 65,400 square meters per metric ton of oven-dry pulp.

DESCRIPTION OF THE PREFERRED EMBODIMENT

Figure 3:
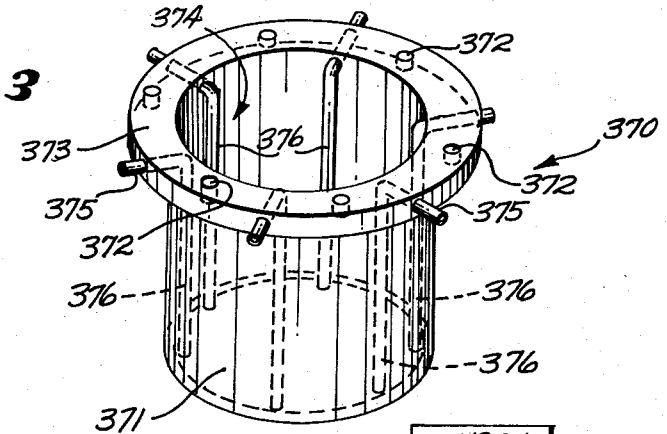
FIG. 3 is an oxygen diffuser used with a refiner to add the oxygen to the refiner.
Figure 4:
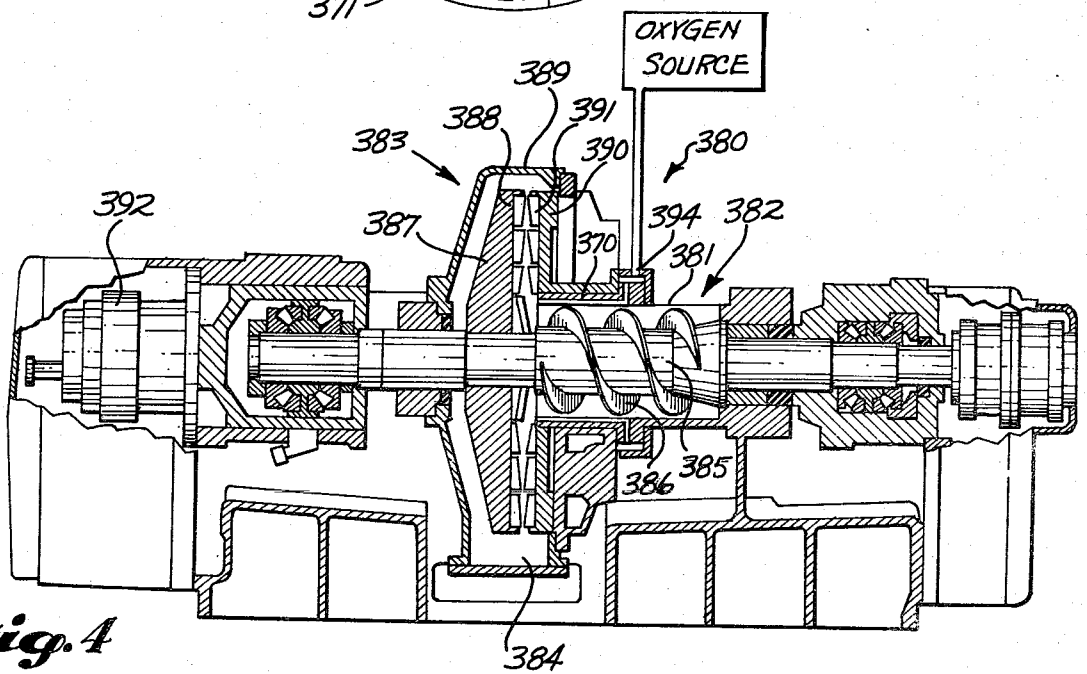
FIGS. 4 and 5 are cross sections of refiners with the diffuser of FIG. 3.
Figure 2:
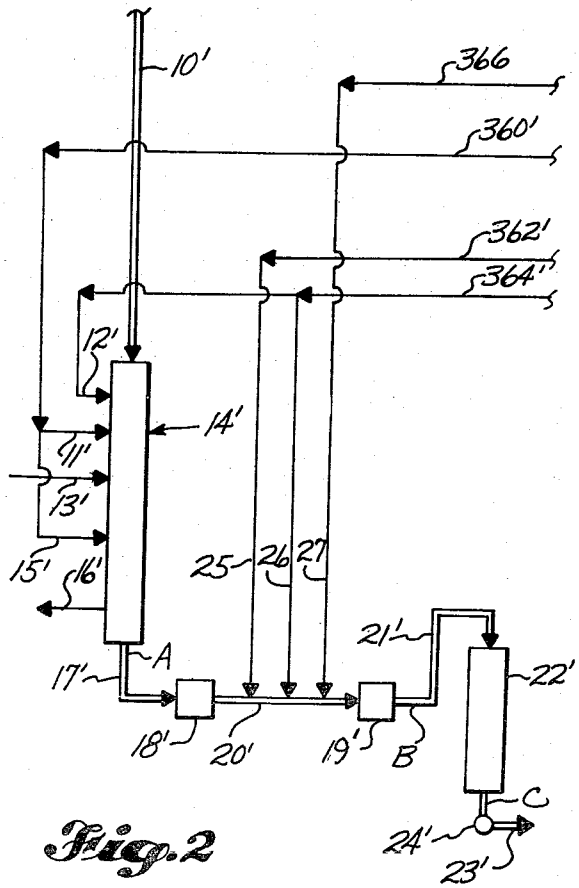
FIG. 2 is a diagram of the present oxygen system used in the blow line in conjunction with a refiner.
Figure 5:
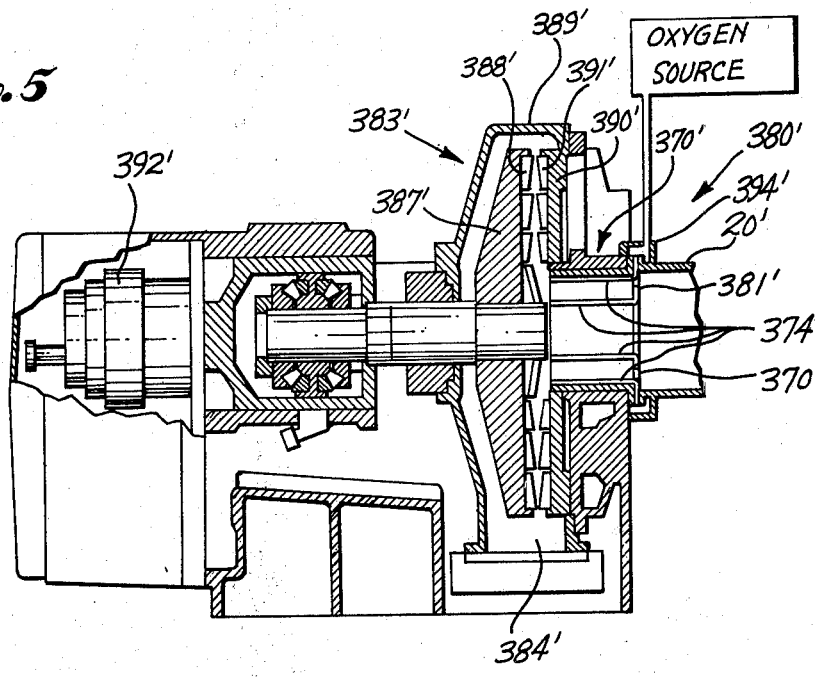

FIGS. 2-5 show our invention applied in the blow line at the refiner. FIG. 2 is a diagram of the process and FIGS. 3-5 are proposed changes to the refiner to add the oxygen to the pulp slurry nearer to the actual refining mechanism.

The system shown in FIG. 2 should be contrasted to the blow line oxygen system described in the Kamyr patent and article noted above. It should be remembered that the Kamyr system required a special upflow-downflow tower after the refiner in order to provide a retention time of at least 20 minutes after treating the pulp with oxygen.

In contrast to this, our system merely requires adding the oxygen, alkali and heat prior to a refiner in a standard continuous digester blow line refining system. In a two-refiner system, the second refiner is preferable because there are more individual fibers in this stage. This is the system shown in FIG. 2.

Figure 1A:
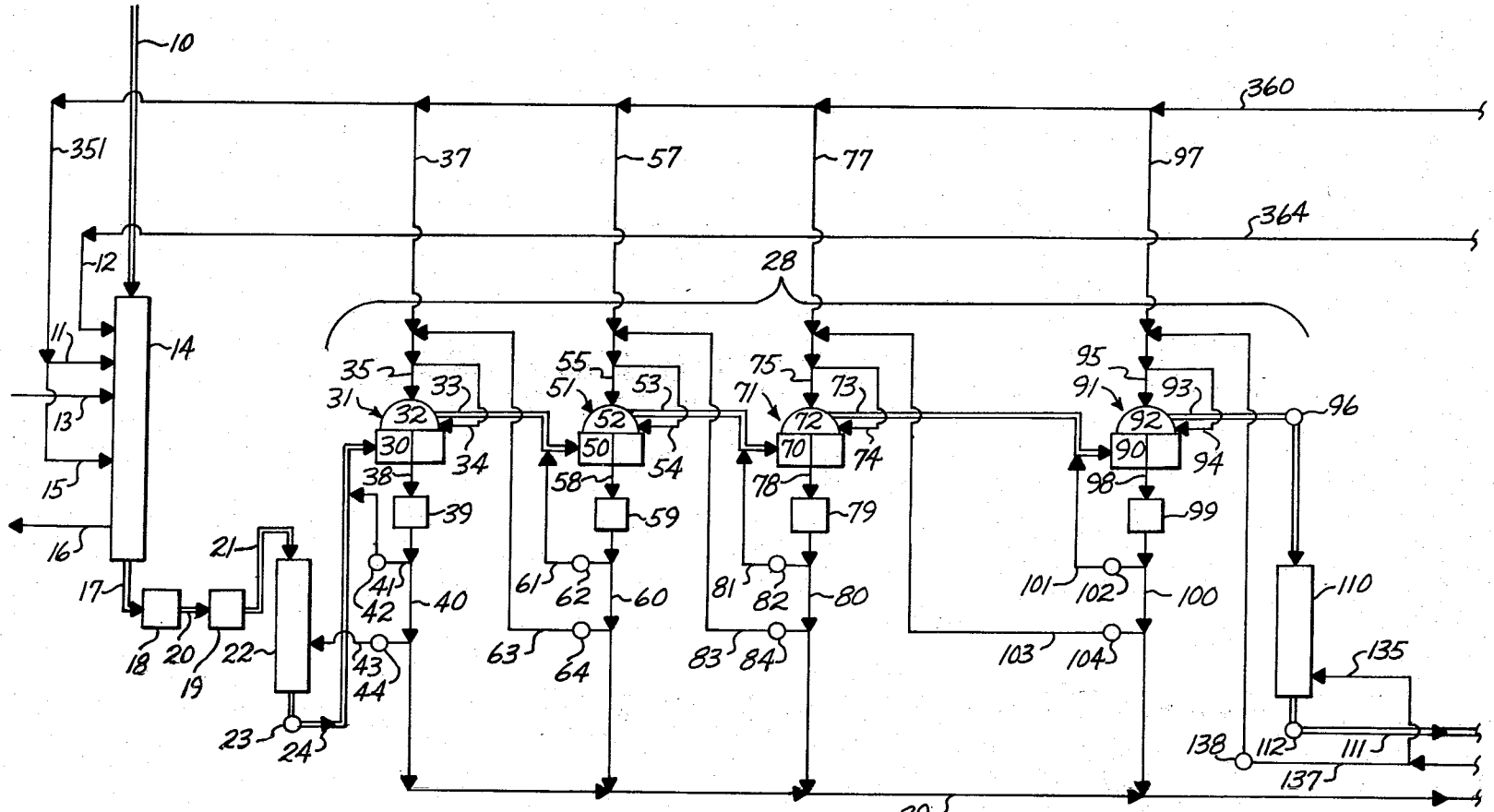
Fig. 1A PRIOR ART
FIG. 1 (A–C) is a diagram of a prior art pulping and bleaching process.
Figure 1B:
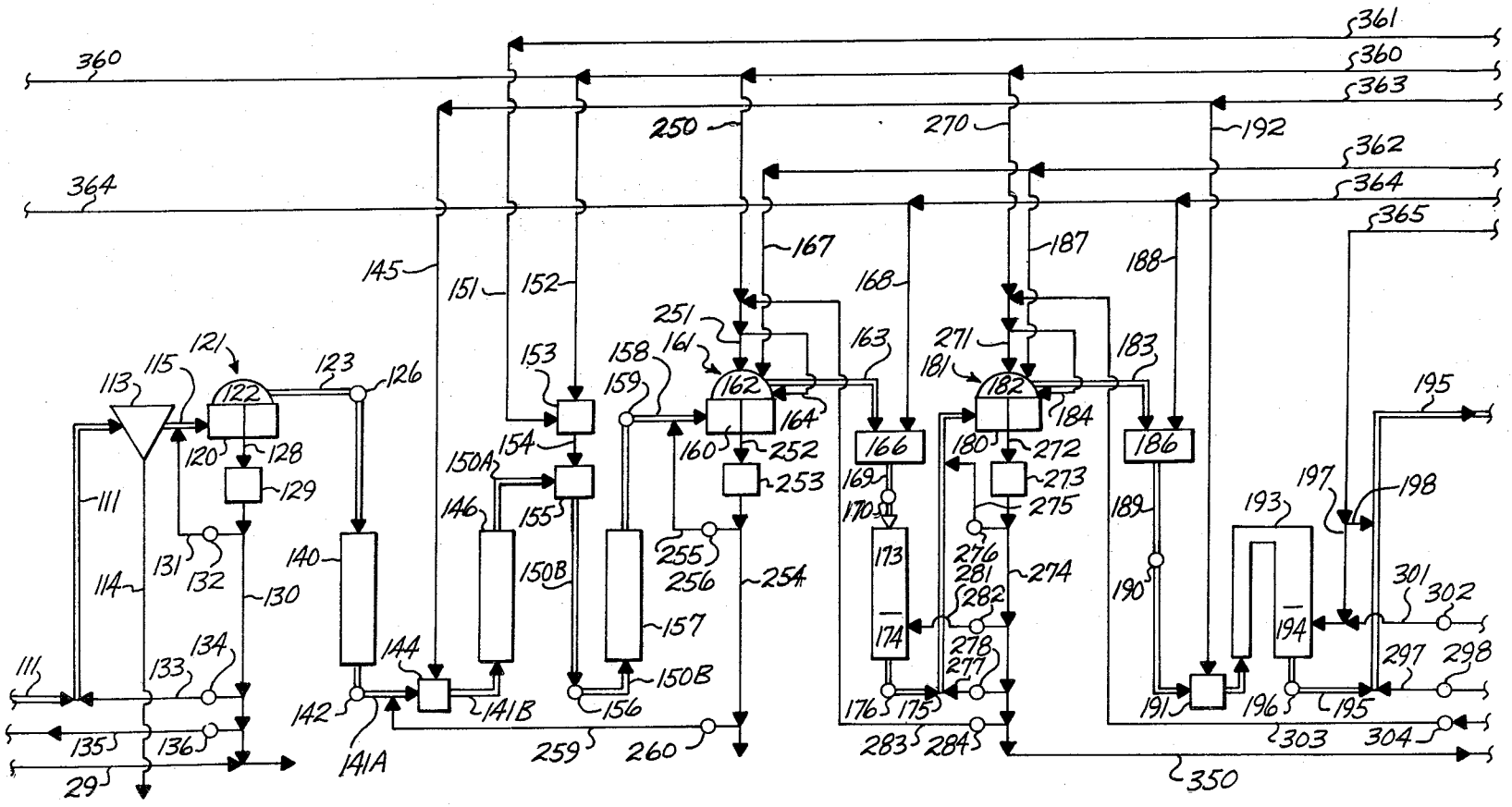
Fig. 1B PRIOR ART
Figure 1C:
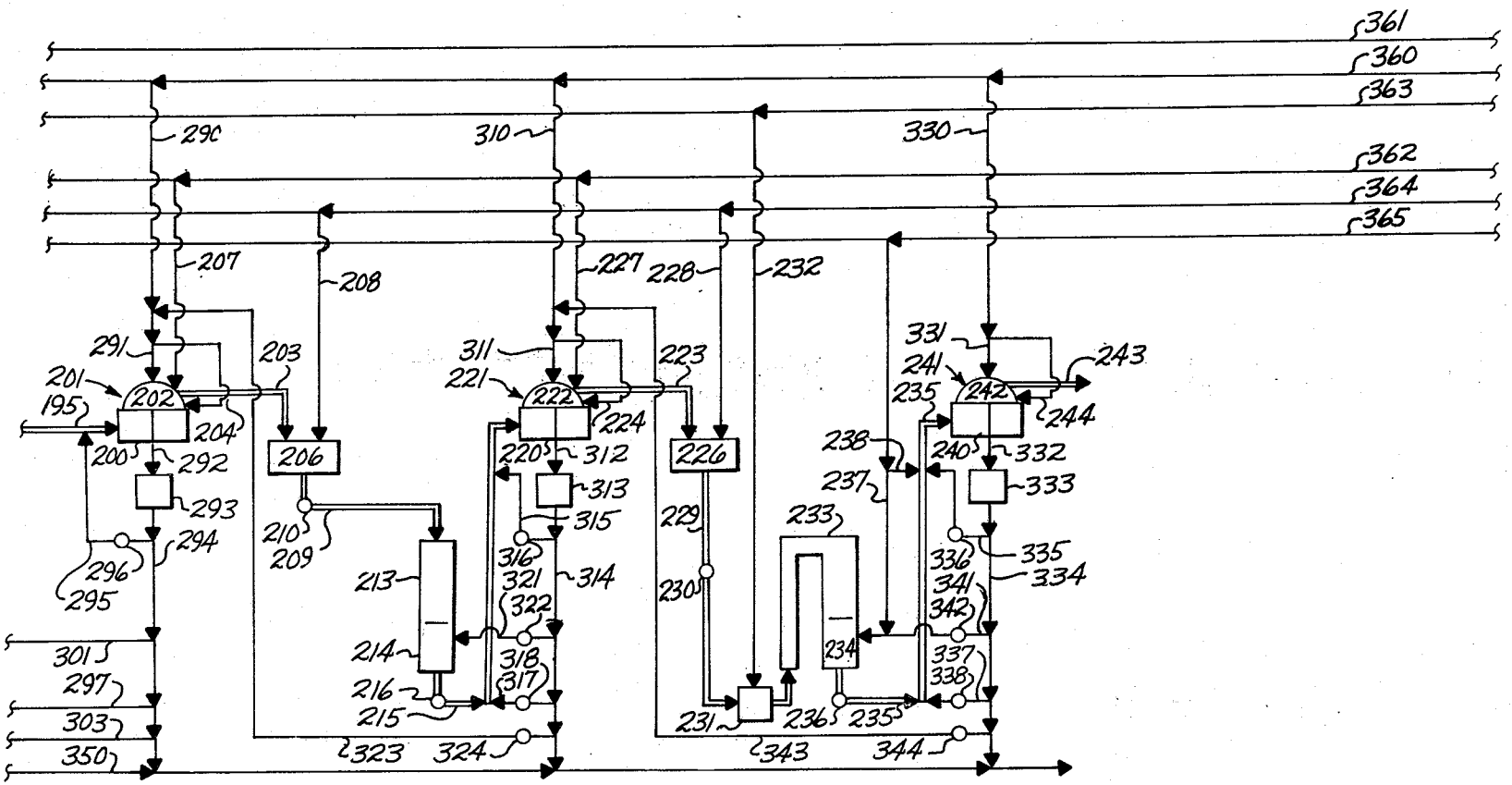
Fig. 1C PRIOR ART

In this figure, the reference numerals are identical to those found in FIG. 1, 10' being the incoming chips, 11' being the process water, 12' being steam, 13' being the pulping chemicals, and 14' being the continuous digester. Again, the chips 10' may be treated prior to entering the digester 14' by presteaming or impregnation with digestion chemicals or any other type of treatment. Again, any type of pulping process may be used, and the pulping conditions for a particular process will depend upon the species of wood chip and the product desired. The pulping conditions and the amounts of chemical are well known.

The digester 14' should be continuous because a major portion of the delignification products should be removed prior to the oxygen treatment. Otherwise too much of the oxygen will be used in reaction with the delignification products and not with the pulp fibers. The washing stage of the continuous digester provides this washing. Reference numerals 15' and 16' refer respectively to the wash water entering and the effluent leaving the washing stage of the continuous digester.

As in FIG. 1, reference numerals 17', 20', and 21' are the three sections of the blow line, 18' and 19' are the two refiners, 22' is the storage tank, or a diffusion washer and tank, and 23' and 24' are the pump and line carrying pulp from the tank 22' to further processing.

The purpose of the present invention is to treat the washed pulp with oxygen with as little change to the equipment as possible. Sodium hydroxide, and steam are added to the pulp slurry in line 20' between refiners 18' and 19'. Sodium hydroxide, which both adjusts the pH of the pulp and buffers the oxygen reaction, is added through line 25. Other suitable alkalies, such as white liquor, may also be used. Steam is added through line 26. The steam raises the temperature of the pulp to a temperature appropriate for the oxygen treatment. Oxygen is added to the pulp through line 27. In a two-refiner system, the addition of the chemicals and steam prior to the second refiner is preferable because there are more individual fibers in the second refining stage.

The lines used to carry these various chemicals to the process are shown in the upper section of FIG. 2. Line 360' carries process water to lines 11' and 15'. Line 362' carries sodium hydroxide to line 25. Line 364' carries steam to lines 12' and 26. Line 366 carries oxygen to line 27. In some instances, the alkali is used both as a digestion chemical and for the oxygen treatment, as in the soda process in which sodium hydroxide is used for both digestion and oxygen treatment, or the kraft process in which white liquor is used for both digestion and oxygen treatment. In this case, line 362' would also supply line 13'.

The amount of oxygen used will depend upon the yield and K or Kappa number of the pulp to be treated, and the desired result of the treatment. Between 5 to 50 kilograms of oxygen per metric ton of oven-dry unbleached wood pulp is required for the oxygen treatment.

In a low yield, low Kappa number pulp the purpose of oxygen treatment would normally be bleaching. The actual yield and Kappa number would depend on the pulping process used, but these pulps are used for bleached products. The blow line and brownstock Kappa number for pulp being used in bleached products is usually around 30 to around 40. The amount of oxygen used to bleach the pulp would be between 5 and 40 kilograms per metric ton of oven-dry pulp.

In a high yield, high Kappa number pulp of the type usually used for linerboard the purpose of the oxygen treatment is to improve certain properties of the product. The blow line and brownstock Kappa number for this pulp is usually around 80 to around 120. This allows the mill either to increase certain property values of the product at the same pulp yield or to maintain the property value while increasing the yield. As an example, the application of 12 to 50 kilograms of oxygen to a high yield, high Kappa number pulp will either increase the ring crush of a liner prepared from the pulp or maintain the ring crush at the same value and increase the yield. Ring crush is determined by TAPPI Standard T 818 OC-76.

Other conditions may need adjustment for oxygen treatment. The pH for any oxygen treatment in any environment should be between 8 and 14. In this environment, the amount of alkali, expressed as sodium hydroxide, required to obtain this pH is between 0.25 to 8% of the oven-dry weight of the unbleached wood pulp. The temperature for any oxygen treatment in any environment is usually between around 65° C. to around 121° C. The usual oxygen stage temperatures are around 82° C. to around 99° C. However, the actual temperature in any oxygen stage will depend upon the ability to heat the pulp, so it may vary from around 65° C. to around 121° C. depending on the location of the oxygen stage in the system. The pulp from the digester may be at the temperature required for the oxygen reaction. If not, the pulp would be heated to either adjust it to or maintain it at the temperature required for the oxygen reaction during the mixing step.

In FIG. 2, there are three sample points labeled A, B, and C. A is in the blow line 17' after the continuous digester 14'; B is in the blow line 21' after refiner 19'; and C is in the outlet from storage tank 22'. These are the three points at which samples were taken and tested in a mill trial of this system.

The pulp left the continuous digester 14' at 71° C. and 1380 kPa gage. Its pH was 10.5. The amount of unbleached pulp passing through the system from the digester throughout the test was 14.3 oven-dry metric tons per hour. The pulp passed through the refiner 19' in up to about 1.5 seconds, and remained in storage tank 22' about 50 minutes. The storage tank 22' was open to the atmosphere, and blow line 21' poured the slurry into the open tank.

The system was first tested for a period of approximately 6 hours to determine the amount of residual lignin in the unbleached pulp at point A and point C to determine if there were any bleaching effects in a standard system. Samples were taken at points A and C at the time intervals indicated in Table I, and the Kappa number of each of the samples was determined. The accuracy of the measurements of these discrete samples was checked during the test by taking a number of samples, averaging the Kappa numbers of these samples and comparing this average to the Kappa number of the discrete sample. These, the A Avg and C Avg Kappa numbers in Table I, and the discrete sample Kappa numbers are within experimental accuracy.

The various Kappa numbers for the samples of unbleached pulp are shown in Table I.

TABLE I

| | Kappa Number | | | | |
|---|---|---|---|---|---|
| Time | A | C | Diff | A Avg | C Avg |
| 0:01 | 28.0 | | | | |
| 0:35 | | 35.4 | | | |
| 1:00 | 33.2 | | | | |
| 1:30 | | 31.2 | | | |
| 2:00 | 32.4 | | | | |
| 2:30 | | 31.9 | | | |
| 3:00 | 32.0 | | | 32.5 | |
| 3:30 | | 29.9 | | | 32.7 |
| 4:00 | 37.6 | | | | |
| 4:30 | | 38.7 | | | |
| 5:00 | 36.4 | | | | |
| 5:30 | | 36.8 | | | 37.8 |
| Avg | 33.3 | 34.0 | +0.7 | | |

From these results, it can be seen that no bleaching occurred between sample point A, the outlet of the continuous digester 14', and sample point C, the outlet of storage tank 22'.

Following the 6-hour control test without oxygen there was a 5¼ hour test using oxygen. The pH and temperature were between 7 and 14 and between around 65° C. and around 121° C. respectively.

During this test, the amount of oxygen added to the pulp was measured approximately every half hour and recorded as pounds of oxygen added per hour. This has been converted to kilograms. Since the flow of unbleached pulp was substantially constant at 14.3 oven-dry metric tons per hour, it was possible to determine the amount of oxygen added in kilograms of oxygen per oven-dry metric ton of unbleached wood pulp.

During the test, the oxygen flow varied from a low of 6.7 kilograms per oven-dry metric ton of unbleached pulp to a high of 40 kilograms per oven-dry metric ton of unbleached pulp. The average oxygen rate was 15 kilograms per oven-dry metric ton of unbleached pulp. Sodium hydroxide was added at a rate of 64 kilograms per oven-dry metric ton of unbleached pulp, and the steam was added at a rate of 612 kilograms per oven-dry metric ton of unbleached pulp. The pulp entered the second refiner 19' at a temperature of 70°–97° C., a pressure of 621 kPa gage and a pH of 12.5.

Pulp samples were again taken at points A and C at the time intervals indicated in Table II and the Kappa numbers of the pulp sample measured. This was to determine whether the oxygen bleached the pulp. These Kappa numbers are given in columns $A_1$ and $C_1$ in Table II. The Kappa number at point C was, on the average, 7.5 points less than the Kappa number at point A during the oxygen treatment, showing that bleaching occurred.

Another series of tests were made to determine where bleaching occurred in the system.

In the first part of these tests, samples were taken again at points A and C to see if there was a correlation between these tests and the other $A_1$–$C_1$ bleaching tests being made at the same time. The results of these correlation tests are in columns $A_2$ and $C_2$ in Table II. It may be seen that the average Kappa number drop for the $A_2$ and $C_2$ tests, 7.8, and the Kappa number drop for the $A_1$ and $C_1$ tests, 7.5, are within experimental accuracy.

The second part of the tests was done during the $A_2$–$C_2$ tests. Samples were also taken at A and B and the Kappa numbers determined. The samples at B were taken at approximately the same time as the samples at A because the pulp is in the refiner 19' for up to about 1.5 to 2 seconds. The maximum time in the refiner would be 10 seconds. The results of these tests are in columns $A_2$ and B of Table II. From these tests it can be seen that the Kappa number drop across the refiner 19' was 7.5, substantially the entire Kappa number drop between point A and point C. These tests indicate, within experimental accuracy, that the entire Kappa number drop, or delignification, occurs in the refiner between points A and B. The first Kappa number at B, 28.5, is the same as the corresponding number at $C_2$, and the second Kappa number at B, 31.4, is almost the same as the corresponding number at $C_2$, 31.5. Consequently, these tests have shown that bleaching occurs in the refiner 19' between the oxygen addition and point B.

TABLE II

| | $O_2$ | $O_2$ | Kappa Number | | | | | | | | | |
|---|---|---|---|---|---|---|---|---|---|---|---|---|
| Time | kg/hr | kg/ODt | $A_1$ | $C_1$ | Diff | $A_2$ | $C_2$ | Diff | $A_2$ | B | Diff | Avg |
| 6:00 | | | 35.0 | | | | | | | | | 36.3 |
| 6:30 | | | | 26.4 | | | | | | | | |

TABLE II-continued

| Time | $O_2$ kg/hr | $O_2$ kg/ODt | Kappa Number $A_1$ | $C_1$ | Diff | $A_2$ | $C_2$ | Diff | $A_2$ | B | Diff | Avg |
|---|---|---|---|---|---|---|---|---|---|---|---|---|
| 6:32 | 196 | 13.7 | | | | | | | | | | |
| 7:00 | 381 | 26.7 | 35.4 | | | | | | | | | |
| 7:30 | | | | 27.2 | | | | | | | | |
| 7:32 | 95 | 6.7 | | | | | | | | | | |
| 7:45 | | | | | | 36.3 | | | | | | |
| 8:00 | | | 35.1 | | | 37.4 | | | | | | |
| 8:02 | 238 | 16.7 | | | | | | | | | | |
| 8:15 | | | | | | 36.8 | 28.0 | | | | | |
| 8:30 | | | | 23.2 | | | 28.3 | | | | | |
| 8:31 | 191 | 13.3 | | | | | | | | | | |
| 9:00 | 191 | 13.3 | 36.0 | | | 37.4 | 29.7 | | 37.4 | 28.5 | −8.9 | |
| 9:30 | | | | 28.7 | | | 28.5 | | | | | |
| 9:40 | 179 | 12.5 | | | | | | | | | | |
| 10:00 | | | 32.1 | | | 37.4 | | | 37.4 | 31.4 | −6.0 | |
| 10:05 | 286 | 20 | | | | | | | | | | |
| 10:15 | 429 | 30 | | | | | | | | | | |
| 10:30 | | | | 29.0 | | | 31.5 | | | | | |
| 10:35 | 143 | 10 | | | | | | | | | | |
| 10:50 | 191 | 13.3 | | | | | | | | | | |
| 10:55 | 572 | 40 | | | | | | | | | | |
| 11:15 | | | | 28.8 | | | | | | | | |
| Avg | 214 | 15 | 34.7 | 27.2 | −7.5 | 37.0 | 29.2 | −7.8 | 37.4 | 29.9 | −7.5 | |

The brightness of samples taken at points A and C was also checked. The average brightness of $A_2$ pulp samples was 18.9 and of $C_2$ pulp samples was 22.3.

During the oxygen tests, a number of other measurements were taken. The shives, unbroken fiber bundles, were measured at points A and C. The average shive content was 2.2 percent of the oven-dry weight of the pulp at point A, and 0.67 percent of the oven-dry weight of the pulp at point C. The filtrate solids in the blow line material were 3.6 percent of the oven-dry weight of the pulp.

The physical properties of the pulp were also tested. These properties were freeness, burst, tear, fold, breaking length, density and viscosity.

The results of these tests are given in Table III. Three sets of data are given. The first set is for an average of all the bleached pulps tested. The second set is for a specific example of pulp. The third set is for a control and is an average of tests of unbleached pulps produced on the apparatus before and after the bleaching trial.

TABLE III

| Physical Test Initial CSF | | Test Pulp Avg 703 | Test Pulp Sample 708 | Control Pulp 715 |
|---|---|---|---|---|
| Time to | 550 CSF | 30 min | 29 min | 34 min |
| Time to | 400 CSF | 49 min | 50 min | 53 min |
| Time to | 250 CSF | 67 min | 68 min | 70 min |
| Burst | Initial | 14.3 | 12.1 | 12.8 |
| Burst @ | 550 CSF | 64.4 | 62.1 | 67.1 |
| Burst @ | 400 CSF | 72.7 | 69.7 | 72.4 |
| Burst @ | 250 CSF | 75.6 | 73.1 | 74.3 |
| Tear | Initial | 229 | 206 | 225 |
| Tear @ | 550 CSF | 176 | 179 | 159 |
| Tear @ | 400 CSF | 160 | 157 | 151 |
| Tear @ | 250 CSF | 151 | 149 | 147 |
| Fold | Initial | 7 | 11 | 5 |
| Fold @ | 550 CSF | 610 | 705 | 545 |
| Fold @ | 400 CSF | 1045 | 1045 | 660 |
| Fold @ | 250 CSF | 1570 | 1365 | 810 |
| Breaking Length | Initial | 2700 m | 2700 m | 2700 m |
| Breaking Length @ | 550 CSF | 7700 m | 7300 m | 8000 m |
| Breaking Length @ | 400 CSF | 8700 m | 7800 m | 8500 m |
| Breaking Length @ | 250 CSF | 9000 m | 8200 m | 8900 m |
| Density | Initial | .49 | .49 | .47 |
| Density @ | 550 CSF | .58 | .58 | .58 |
| Density @ | 400 CSF | .61 | .62 | .60 |
| Density @ | 250 CSF | .62 | .63 | .62 |

TABLE III-continued

| Physical Test Initial CSF | Test Pulp Avg 703 | Test Pulp Sample 708 | Control Pulp 715 |
|---|---|---|---|
| Viscosity | 75 | 76 | 61 |

It was necessary during this test that the means for adding the oxygen, steam, and sodium hydroxide be of the simplest possible type. In each instance, the chemicals were added through pipes extending into the blow line 20'. The lines were upstream of refiner 19'.

To determine the ability of oxygen to change the properties of pulp, a pulp having a Kappa number of 120 and a yield of 58.6 was treated with oxygen in pilot plant equipment. The equivalent of 20 kilograms of oxygen per metric ton of oven-dry pulp was applied to the pulp. The temperature was 90° C. Sodium hydroxide addition was 4% of the weight of the oven-dry pulp. No protector, such as magnesium oxide, was added. In fact, no protector was used in any of the experiments described in this application.

The treated pulp had a Kappa number of about 65. It was compared to a kraft pulp having a 58 Kappa number. The tests were at 675 Canadian Standard Freeness. The oxygen treated pulp had a ring crush 15% greater than the kraft pulp and a burst 2% greater than the kraft pulp.

Again the actual chemical application will depend upon the starting pulp and whether it is desired to increase properties or yield. The oxygen application may be from 12 to 50 kilograms per metric ton of oven-dry pulp. The alkali addition, expressed as sodium hydroxide, would normally be from 3.6 to 4.9% and the temperature would normally be from 82° to 95° C. A slight amount of protector might be used. This would not exceed 0.5% based on the weight of the oven-dry pulp.

The final product would have a Kappa ranging from 65 to 69; a ring crush, compared to a kraft pulp, of from 3% less when yield is increased to 28% more if better properties are desired; and a burst, compared to kraft pulp, of the same number if yield is increased to 6% greater if better properties are desired.

Much of the treatment would occur in the mixer and a majority in the mixer and through to the back pressure valve or top of the pipe in the mixer outlet line.

FIGS. 3, 4 and 5 show a unit that would provide better distribution of oxygen. FIG. 3 shows the distribution unit by itself and FIGS. 4 and 5 show cross sections of refiners which include the unit.

The unit 370 consists of an inlet sleeve 371 which fits into the refiner casing inlet and is fixed in place by bolts which extend through holes 372 in flange 373. There are a plurality of L-shaped tubular diffusers 374 equally spaced and oriented axially around the sleeve and flange. Each diffuser has an inlet section 375 and an outlet section 376. The inlet section 375 extends radially along flange 373 and the outlet section 376 extends longitudinally of the sleeve 371. The tube may have any cross section. There are several ways of attaching the diffusers 374 to the sleeve and flange. The inlet section 375 may be along the interior or exterior face of flange 373, be fitted in recesses in the interior or exterior face of flange 373, or be within and formed by the walls of the flange. In the latter design, an outlet tube would extend radially from the flange 373 as shown in FIG. 2. Similarly, the outlet section 376 could be affixed to the inner or outer wall of the sleeve 371, fitted into recesses in the inner or outer walls of the sleeve or be within and formed by the walls of the sleeve. They would be formed within and by the walls by casting when the sleeve and flange are formed or by drilling through the wall. The preferred form is shown in FIG. 3. The inlet section 375 is formed in the flange and the outlet section 376 affixed to the inner wall of the sleeve. The diffuser will have one or more outlets for oxygen. Six diffusers should adequately disperse the oxygen in the pulp.

In FIG. 4, the unit is shown with a refiner. A single disc refiner is shown. Only the major portions of the refiner are identified.

The refiner 380 has an inlet 381, a screw conveyer section 382, a refiner section 383, and an outlet 384. The refiner shaft 385 is within the casing. Attached to the shaft are screw conveyer 386 and the revolving refiner member 387. The revolving refiner plate 388 is attached to member 387. Attached to the refiner casing 389 are the fixed refiner member 390 and the fixed refiner plate 391 which is aligned with revolving plate 388. The shaft 385, conveyer 386, revolving refiner member 387 and plate 388 are rotated by a suitable motor 392.

In this refiner, the unit 370 would be part of the wear plate for the conveyer. The diffusers 374 would either be recessed in the sleeve 371 or formed in the sleeve as described above. This would allow the oxygen to be admitted after the conveyer section. Oxygen is fed to the diffusers through the oxygen manifold 394. The oxygen enters the diffusers 374 through the manifold 394 and is added to the pulp after the conveyer 386. The oxygenated pulp leaves the refiner through the outlet 384.

The blow line 20′ is attached to inlet 381.

FIG. 5 shows the use of unit 370 in a refiner that does not have a conveyer section. The reference numerals are the same as in FIG. 3.

In any type of refiner there is relative rotative movement between two opposed surfaces which are spaced to allow passage of material between them. Disc refiners are normally used bacause of the ability to change the clearance and pressure on the plates, depending on the furnish to the refiner and the end product desired. There are other types of refiners that may be used. In the usual double-disc refiner, the rotating disc has refiner plates on both faces which act against opposing fixed plates. Another type of double-disc refiner has both refiner plates mounted on discs which rotate in opposite directions to provide both a rolling and an abrading action. The discs are mounted on separate shafts which may be concentric. A conical refiner may also be used.

Figure 6:
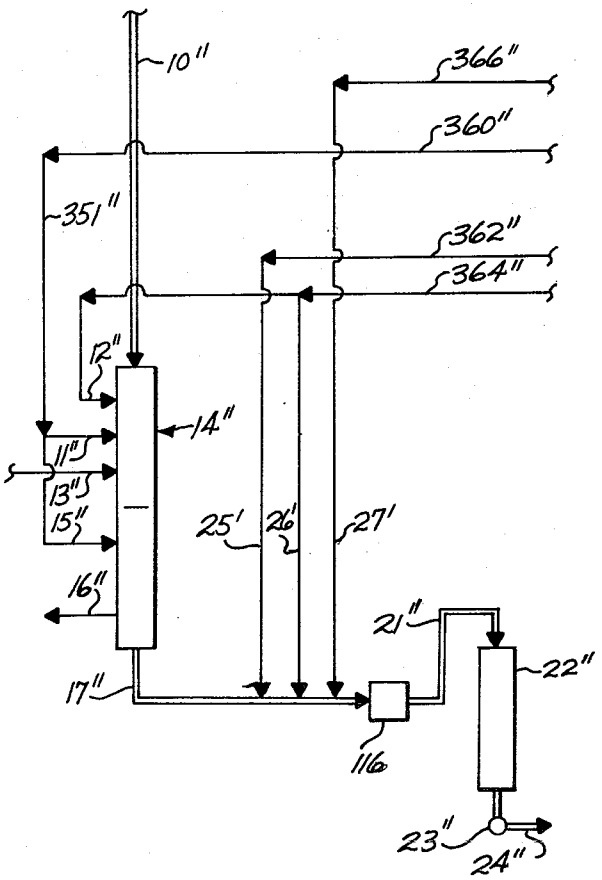
FIG. 6 is a diagram of a modified system used in the blow line.

In some installations, there is no refiner in the blow line between the continuous digester 14 and the blow tank 22. It is now possible to achieve good treatment by the simple addition of the alkali, steam and oxygen lines, and a mixer, such as mixer 116, into the blow line. This is shown in FIG. 6. The other reference numerals are the same as those in FIG. 2.

Mixer 116 may be a refiner such as the refiner shown in FIGS. 4 or 5. For example, the refiner, when stopped, may be used as a mixing device. The clearance between discs has been tested at around 13 mm and can be up to 75 mm. Consequently, the clearance may be from a few millimeters to around 75 millimeters. This narrow passage causes the pulp slurry and oxygen to mix. Another suitable mixer would be one that is relatively small and intensively mixes the pulp and gas. Several suitable mixers are described later in this application.

There should be a back pressure on the pulp in the mixer or refiner. This may be provided by an upflow line after the mixer which creates a hydrostatic head at the mixer. A pressure valve is preferred. The valve may be combined with the upflow line. The valve may be placed in the blow line 21′ downstream of the refiner 19′ or line 21″ downstream of the mixer 116. The valve may be either right after the mixer or refiner or at the top of the line before the outlet.

The maximum pressure in the mixer would normally not exceed 830 kPa gage, and at the top of the pipe would normally not exceed 345 kPa gage.

Figure 7:
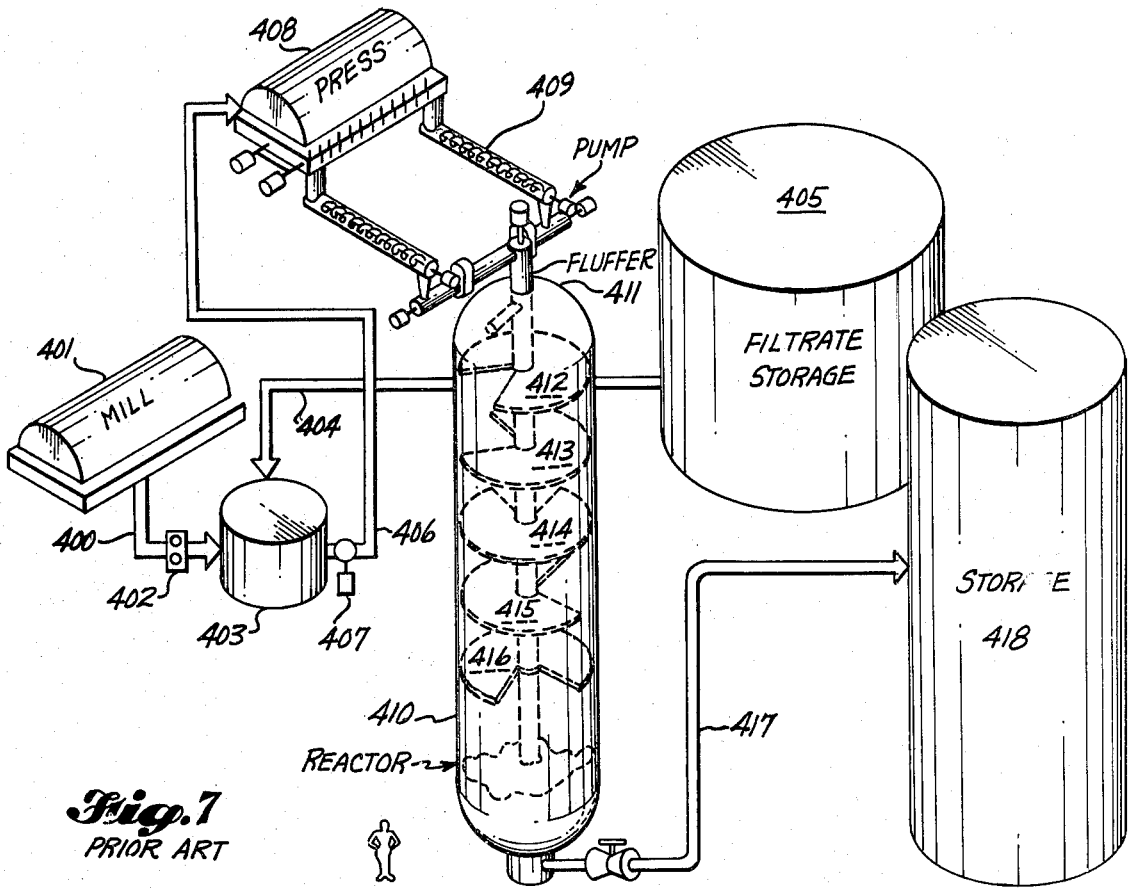
Fig. 7 PRIOR ART
FIG. 7 is a diagram of a prior art oxygen bleaching system.
Figure 8:
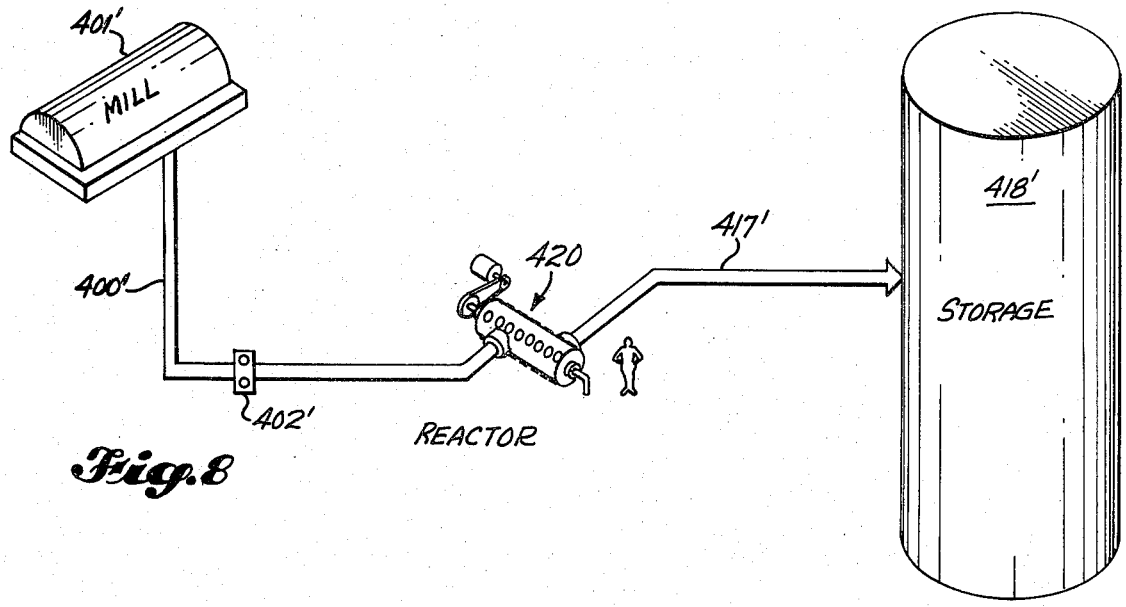
FIG. 8 is a diagram of the present oxygen bleaching system.

FIGS. 7 and 8 compare the size and complexity of a prior art oxygen bleaching system of the type shown in Verreyne et al. U.S. Pat. No. 3,660,225 with the present system. Both drawings are to the same scale. Both units would handle the same amount of pulp in an oven-dry weight basis.

In the prior art system shown in FIG. 7, pulp 400 from mill 401 is carried by pump 402 to a storage tank 403. In storage tank 403 the pulp is mixed with an alkali solution 404 from filtrate storage tank 405. A protector would be added to the pulp at this time also. The treated pulp mixture 406 is moved by pump 407 to a dewatering press 408 which removes enough water from the pulp to raise the consistency of the pulp slurry to around 20–30%. This material is then carried by pump 409 to the top of the oxygen reactor. The pump 409 is a series of screw conveyers, the only way to pressurize pulp of this consistency. At the top of the reactor 410 is a fluffer 411 which spreads the pulp uniformly over the top tray 412 of the reactor. The pulp passes down through the other trays 413–416 and is treated with oxygen during its passage through the trays. From the bottom of the trays the bleached pulp 417 is carried to storage tank 418.

This mill should be contrasted to the present system shown in FIG. 8. The mixing tank 403, filtrate storage tank 405, press 408, pump 409, and reactor 410 have been replaced by a simple mixer 420 in which the oxygen is mixed with the pulp 400′.

By comparison, the system of FIG. 7 requires a power six times as large as the mixer or system of FIG.

8. For the same quantity of pulp, the system of FIG. 7 would require an aggregate of 2238 kW in motors to operate the reactor and the various pieces of equipment associated with the reactor, while the mixer of FIG. 8 would require a 373 kW motor.

The mixer of FIG. 8 is also able to operate at consistencies usually found in pulping and bleaching systems. This would usually be the consistency of pulp leaving the washer or the subsequent steam mixer, a consistency of around 8 to 15% from the washer and around 1% less for the steam mixer.

Figure 9:
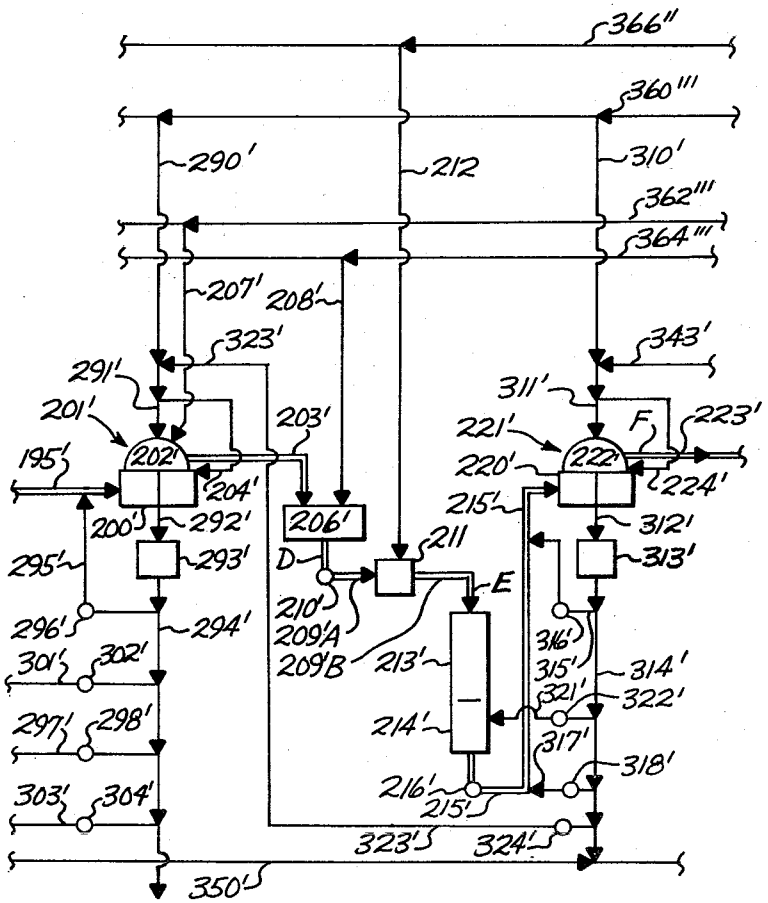
FIG. 9 is a diagram of the present oxygen system in an extraction stage.

FIG. 9 shows the oxygen mixer in a standard caustic extraction stage of a bleaching system. It shows that a simple change can turn a caustic extraction stage into an oxygen treatment stage. To allow comparison of this extraction stage with the same one in FIG. 1, the same reference numerals have been used. The operation of the various pieces of equipment the washers 201' and 221', the steam mixer 206', the extraction tower 213' and the seal tanks 293' and 313'—are the same as in the prior art extraction stage in FIG. 1.

The flows of pulp and wash water through the system are also the same as in FIG. 1.

The pulp 195' enters washer 201' where it is washed, dewatered and treated with alkali, usually sodium hydroxide. The consistency of the pulp leaving the washer is usually in the range of 8 to 15%. The exiting pulp 203' then is mixed with the alkali and steam in steam mixer 206'. Pulp consistency is reduced about 1% in the steam mixer. From the steam mixer the pulp goes to extraction tower 213' where it remains for the usual period of time. It is diluted and carried to washer 221', where it is washed and dewatered.

Although washer 221' may be a diffusion washer, it is shown and described as a vacuum or pressure drum washer.

In washer 221' the water is either fresh process water through line 310', counterflow filtrate through line 343' or a combination of these, and in washer 201' the wash water is either fresh process water through line 290', or counterflow filtrate through line 323', or a combination of these.

The filtrate from washer 201' is stored in seal tank 293' and is used as dilution water through lines 295', 297' and 301', as wash water through line 303', or sent to effluent treatment through line 294'. It is shown being treated separately from effluent in line 350' because the effluent, if from a chlorine stage, would be treated separately from effluent from an oxygen stage.

Similarly, the filtrate from washer 221' is stored in seal tank 313' and used as dilution water through lines 315', 317' and 321', as wash water through line 323', or treated as effluent through line 314'. Since the oxygen effluent has little, if any, chlorine components, it may be combined with the effluent from the brownstock washers and the digester and be treated in the recovery furnace thus reducing the amount of material that must be sewered to an adjacent stream or body of water.

The supply lines are 360''' for process water, 362''' for sodium hydroxide solution, and 364''' for steam.

The description of the stage so far is, with the exception of splitting the effluent stream, identical to the description of the extraction stage in FIG. 1. Only one minor change is required to turn this extraction stage into an oxygen stage. That is the addition of the oxygen mixer 211 into line 209', of the oxygen line 212 to either the mixer 211 or the line 209'A just in front of the mixer and of the oxygen supply line 366''. The pulp leaves steam mixer 206' through line 209'A and enters the oxygen mixer 211 and the oxygenated pulp leaves the mixer 211 through line 209'B and enters the extraction tower 213'. The amount of oxygen supplied to the pulp would be 11 to 28 kilograms per metric ton of oven-dry pulp. A preferred range is 17 to 22 kilograms of oxygen per metric ton of oven-dry pulp.

All conditions—time, temperature, pressure, consistency, pH and chemical addition—may remain about the same as they were in the extraction stage shown in FIG. 1. The temperature would normally be increased from 71°-77° C. for an extraction stage to 82°-88° C. for an oxygen treatment stage, because the treatment is improved at higher temperatures. Again, the temperature may be as high as 121° C. The amount of alkali, expressed as sodium hydroxide, is 0.5 to 7% of the weight of the oven-dry pulp. Channeling of the oxygen after mixing is of no particular consequence. If the extraction tower was a downflow tower, it remains a downflow tower. The physical location of mixer 211 is a matter of convenience, the simplicity of installation and maintenance being the sole criteria. If it can be placed in an existing line, it will be. If convenience requires that it be placed on the floor of the bleach plant, it will be placed on the floor of the bleach plant and an external pipe can carry the pulp slurry to the top of the extraction tower 213'.

The mixing produces an intimate contact between the gas and the slurry, and appears to divide the gas into mostly small bubbles. There may be some larger bubbles and gas pockets, however. The presence of some large bubbles and gas pockets up to the size of the pipe through which the pulp slurry was passing have been observed. These have not affected the quality of the pulp or the treatment of the pulp.

Again there should be a back pressure on the pulp in the mixer. This may be provided by an upflow line after the mixer which creates a hydrostatic head at the mixer. A pressure valve is preferred. The valve may be combined with the upflow line. The valve may be placed in the line 209'B downstream of the mixer 211. The valve may be either right after the mixer or at the top of the line before the outlet.

The maximum pressure in the mixer would normally not exceed 830 kPa gage, and the top of the pipe would normally not exceed 345 kPa gage.

In a mill trial of the system, sampling was done at D, E and F. At point E, sampling was at the top of the tower 213' rather than directly after the mixer 211 because it was not possible to sample after the mixer. It required about 1 minute for the slurry to reach point E from the mixer. In these tests the mixer was on the bleach plant floor and an external line carried the slurry to the top of the tower.

TABLE IV

| | PBC | |
|---|---|---|
| D | E | F |
| 1.4 | 1.13 | 0.95 |
| 1.41 | 1.13 | 0.90 |

Figure 10:
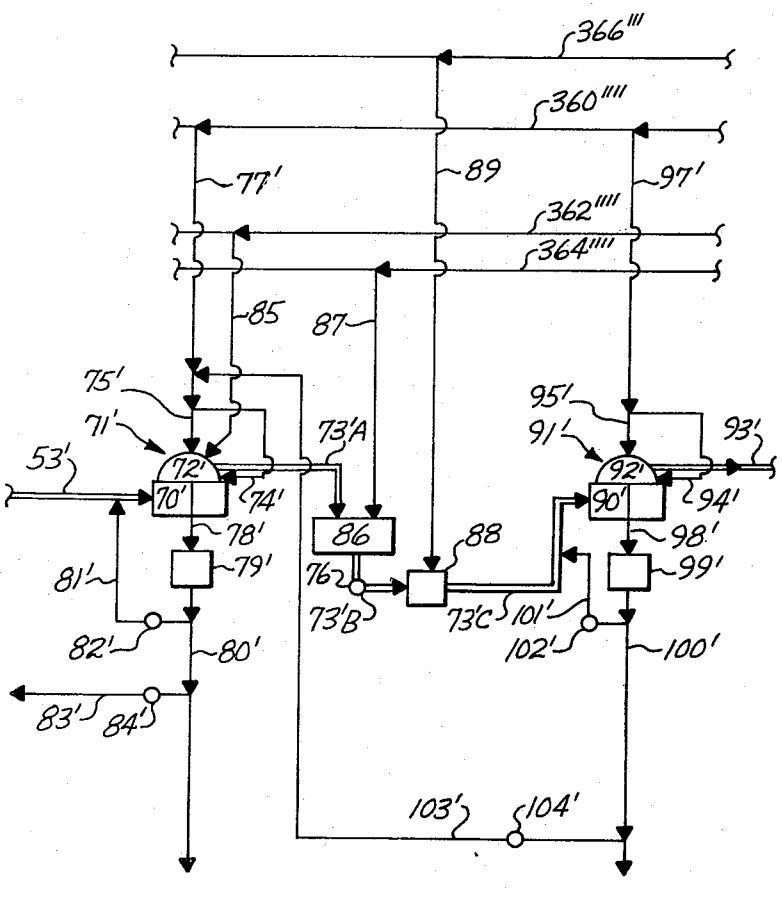
FIG. 10 is a diagram of the present oxygen system between washers.

FIG. 10 shows the oxygen mixer between two washers. In this case the washers are brownstock washers. Again, the reference numerals are the same as those found in FIG. 1 and the conditions in these two washers are the same as those noted in FIG. 1.

The differences between this unit and that in FIG. 1 are the addition of steam mixer 86, pump 76, mixer 88, and lines 85, 87 and 89. Line 85 adds alkali onto the mat 73'A as it is leaving the washer 71'. The amount of alkali, expressed as sodium hydroxide, placed on the mat is between 0.1 and 6%, preferably between 2 and 4%, based on the oven-dry weight of the pulp. The treated mat 73'A is then carried to steam mixer 86 in which it is mixed with the alkali and with steam from line 87 to increase the temperature of the pulp to 65°-88° C. and possibly as high as 121° C. From steam mixer 86 the pulp slurry 73'B is carried by a pump 76 to a mixer 88 in which it is mixed with oxygen from line 89. The amount of oxygen added will depend upon the K number of the pulp and the desired result. The reasons for adding oxygen in the brownstock washers are the same as for adding it in the blow line and the same amounts would be used. This will normally range from 5 to 50 kilograms per metric ton of oven-dry pulp. Two standard ranges for bleaching in a brownstock system are 22 to 28 and 8 to 17 kilograms of oxygen per metric ton of oven-dry pulp. The latter is a preferred range. The oxygenated pulp 73'C then passes to the vat 90' of washer 91'.

The washer after the mixer may be a diffusion washer.

Again there should be a back pressure on the mixer. This pressure is provided in the same way that the pressure is provided to mixer 211, by an upflow line, a pressure valve or a combination of these. The placement of the valve and the maximum pressure are the same as those for mixer 211.

Figure 11:
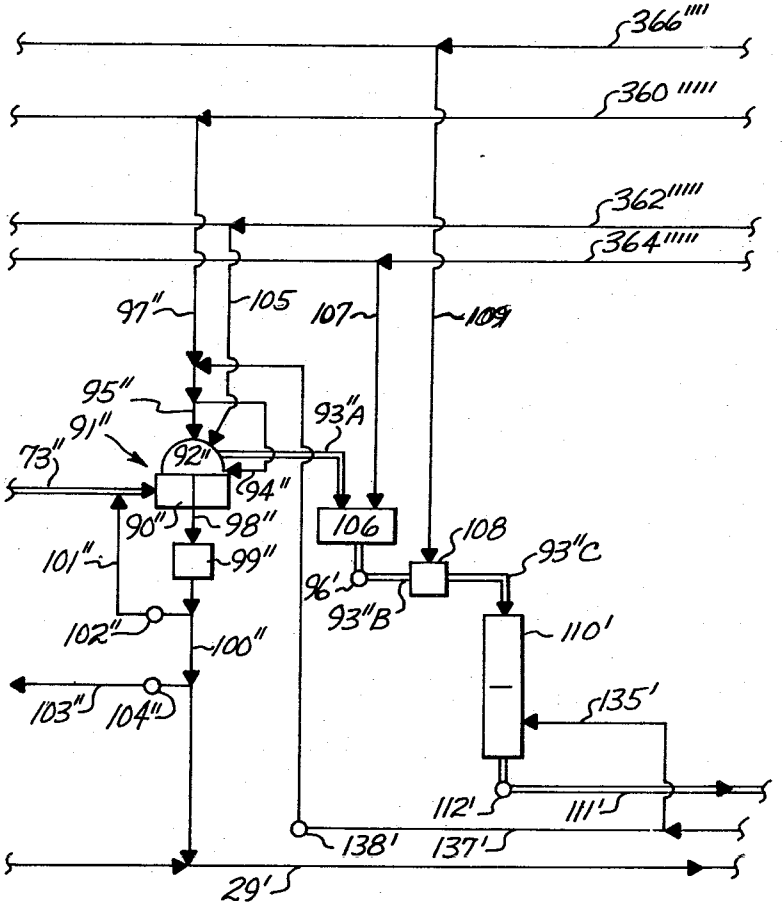
FIG. 11 is a diagram of the present oxygen system between a washer and storage.

FIG. 11 discloses a system placed between a washer such as brownstock washer 91'' and a storage tank such as storage tank 110'. Again the reference numerals are same as those used in FIG. 1. The changes are the addition of steam mixer 106, mixer 108, alkali line 105 and its supply line 362'''', steam line 107 and its supply line 364'''', and oxygen line 109 and its supply line 366''''. The amount of alkali and oxygen added to the pulp, the temperature of the pulp, and the time between alkali addition and oxygen addition and the pressure at the mixer and in the outlet line and the methods of obtaining these pressures are the same as in the system of FIG. 10. The other operating conditions would remain the same as in FIG. 1.

In each of these systems, the time between alkali addition and oxygen addition is usually from 1 to 5 minutes. The exact time will depend upon equipment placement and pulp speed.

A mill trial was run using the system shown in FIG. 11. In this system, the mixer 108 was floor mounted and the pipe 93''C carried the slurry from mixer 108 to the top of tower 110'. The tower was open to the atmosphere. A partially closed valve near the outlet of pipe 93''C created a 276 kPa gage back pressure in the line. The hydrostatic pressure in the line was 241.5 kPa gage, so the pressure within the mixer was 517.5 kPa gage.

Four trial runs were made under slightly different conditions to determine both the overall delignification effect of the system and the percentage of delignification taking place within each section of the system. K number measurements were taken before and after mixer 108, at the outlet of pipe 93''C, at the outlet of tank 110', and at the outlet of the decker 121' (FIG. 12*b*) downstream of the tank 110'.

In a control run in which no oxygen was added to the system, it was determined that the K number was reduced by 1 number between the inlet of mixer 108 and the outlet of decker 121'. This probably was due to screening. In the overall delignification computation, the numbers were corrected for this 1 K number drop.

The various K numbers were taken within the system to determine the percentage of the total delignification or K number reduction taking place through the mixer 108, through pipe 93''C, through tank 110', and through decker 121'. Washer showers had been added to the decker for these tests. The slurry required between 10 to 15 seconds to pass through mixer 108, 2½ to 3½ minutes through pipe 93''C, and ½ to 3 hours through tank 110' or decker 121'. It was determined that in these tests, 30% of the total delignification occurred in mixer 108, 40% occurred in pipe 93''C, 8% occurred in tank 110', and 21% occurred between the tank and the decker. This latter reduction is caused by screening of the pulp.

Table V gives the actual conditions in the mixer: the temperature in degrees C.; the kilograms of caustic, expressed as sodium hydroxide, and oxygen per oven-dry metric ton of pulp; the pressure in kilopascals gage; the K numbers at the various locations within the system; and the percent K number reduction. In Run No. 1, the percent reduction at the decker outlet in the last line is the reduction between the tip of the pipe and the decker outlet.

TABLE V

| | Runs | | | |
|---|---|---|---|---|
| | 1 | 2 | 3 | 4 |
| Mixer Conditions | | | | |
| Temp. °C. | 79.5 | 82 | 93 | 88 |
| Caustic, kg/O.D.t. | 15.1 | 20.2 | 15.1 | 20.2 |
| Oxygen, kg/O.D.t. | 22.7 | 25.2 | 20.2 | 25.2 |
| Pressure, kPa gage | 517.5 | 517.5 | 517.5 | 517.5 |
| Overall Delignification | | | | |
| Before Mixer | | | | |
| K No. | 19.6 | 25.4 | 19.9 | 24.1 |
| K No. Corrected | 18.6 | 24.4 | 18.9 | 23.1 |
| After Decker | | | | |
| K No. | 15.6 | 19.2 | 15.1 | 17.8 |
| % K No. Reduction | 16 | 21 | 20 | 23 |
| Delignification Within System | | | | |
| Mixer Inlet | | | | |
| K No. | 19.6 | 25.4 | 19.9 | 24.1 |
| Mixer Outlet | | | | |
| K No. | 18.5 | 23.3 | 18.6 | 21.3 |
| % of Total Reduction | 25 | 34 | 27 | 29 |
| Top of Pipe | | | | |
| K No. | 16.8 | 21.5 | 16.0 | 19.8 |
| % of Total Reduction | 44 | 29 | 54 | 40 |
| Tank Outlet | | | | |
| K No. | — | 20.5 | 16.0 | 19.3 |
| % of Total Reduction | — | 16 | 0 | 8 |
| Decker Outlet | | | | |
| K No. | 15.6 | 19.2 | 15.1 | 17.8 |
| % of Total Reduction | 31 | 21 | 19 | 23 |

This data indicates that in any of the systems described in this application, a valve should be placed in the line downstream of the oxygen mixer to provide back pressure on the mixer. It also indicates that much of the delignification occurs in less than a minute in the mixer. It may be in 10-15 seconds or less. Most will occur in a few minutes in the mixer and the outlet pipe immediately after the mixer.

The maximum pressure in a mixer would normally not exceed 830 kPa gage, and the pressure at the top of the pipe if a hydrostatic leg is used would normally not exceed 345 kPa gage.

The mixer has also been operated under a hydrostatic pressure only.

Figure 12A:
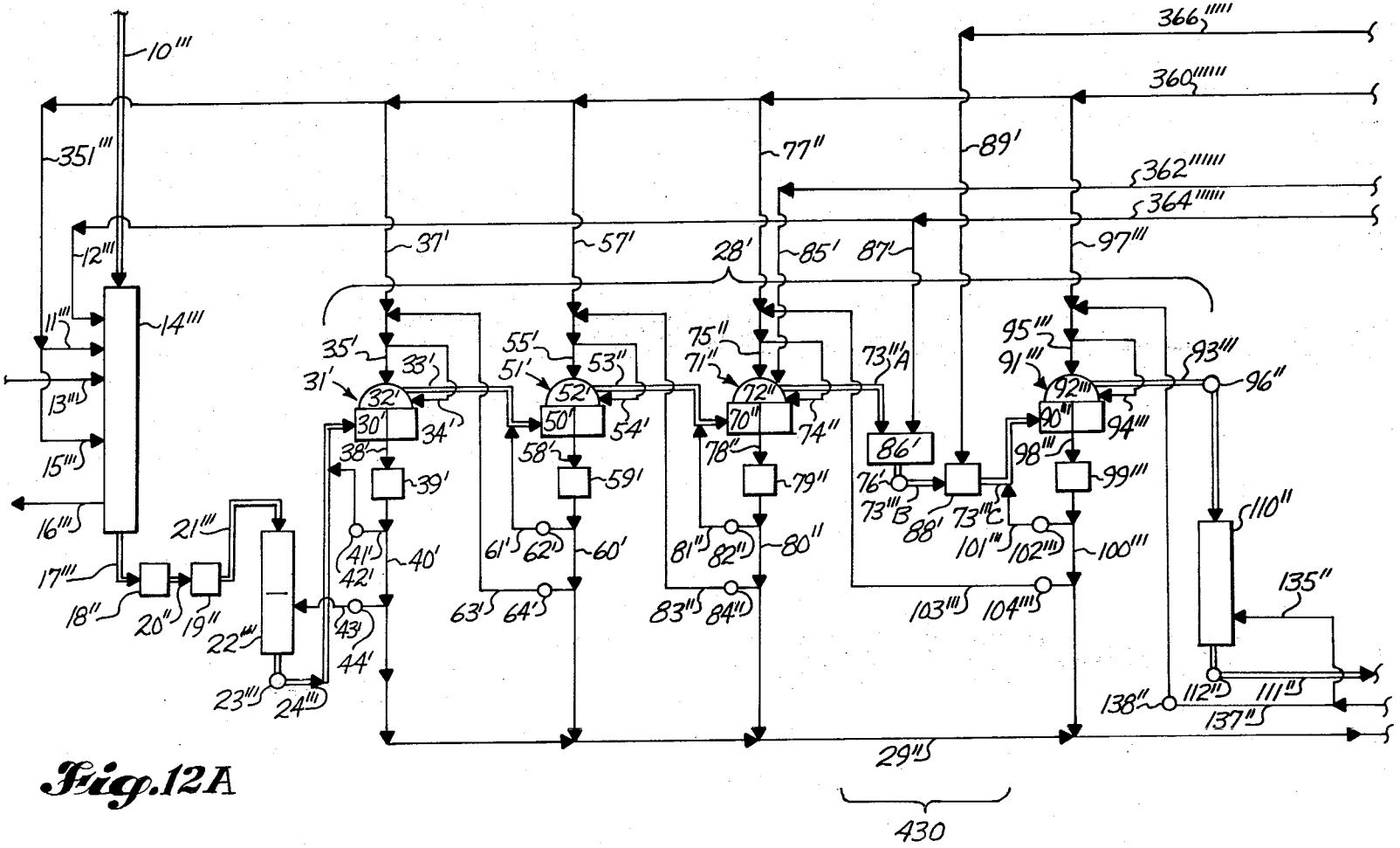
FIGS. 12 (A–C) is a diagram of a pulping and bleaching process using the oxygen bleaching systems of FIGS. 8 and 9, and a modification of FIG. 11.
Figure 12B:
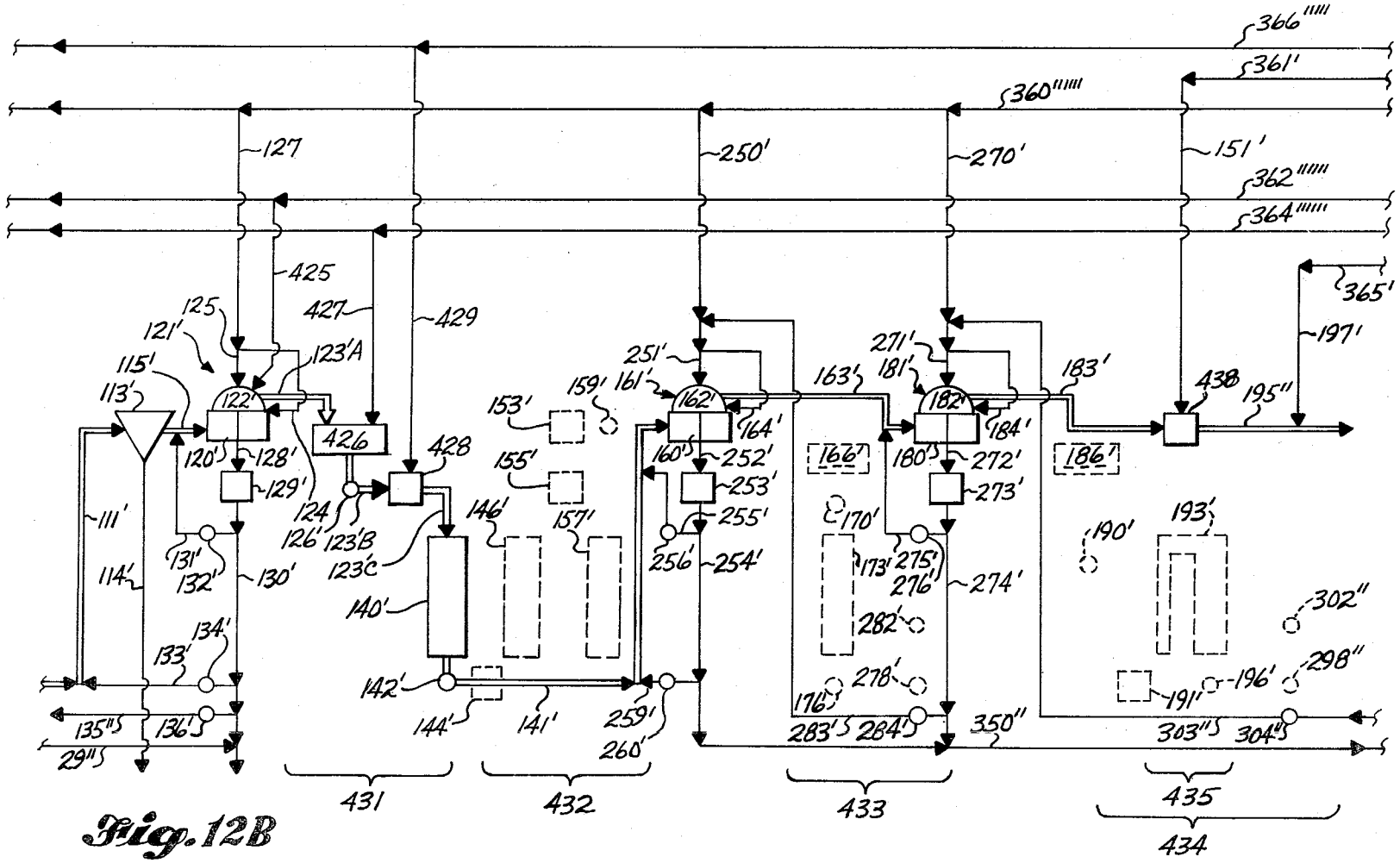
Figure 12C:
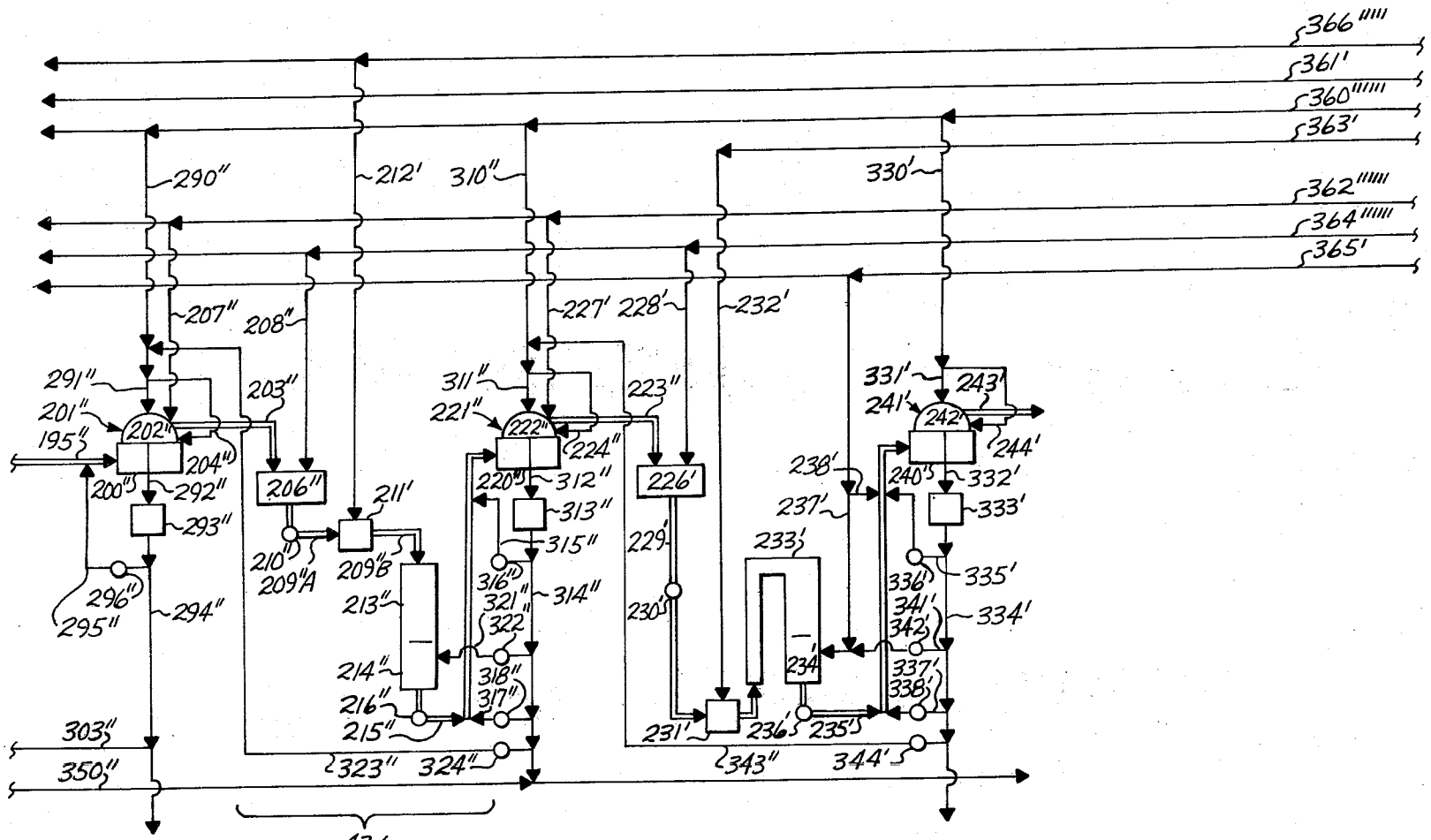

The oxygen systems of FIGS. 9, 10 and 11 are shown in a bleaching system in FIG. 12. FIG. 12 shows the same overall system as FIG. 1 and the same reference numerals are used throughout these figures. The system shown in FIG. 1 includes digestion of the wood chips in either a batch or continuous digester, brownstock washing, screening, dewatering in decker 121 and a $D_c$EDED bleach sequence. FIG. 12 shows digestion, brownstock washing, screening, and an OOCOD bleach sequence. For the most part, the operating conditions—time, temperature, pH, consistency and chemical addition—are the same in FIG. 12 as they were in FIG. 1.

The differences between the system in FIG. 12 and that in FIG. 1 is indicated by brackets at the bottom of FIG. 12.

The first difference between the process shown in FIG. 12 and that shown in FIG. 1 is indicated by bracket 430. This is the washer oxygen system of FIG. 10 and again the reference numerals and operating conditions for this oxygen stage are the same as that given for the oxygen stage in FIG. 10. Since an oxygen treatment stage should have washed pulp, the oxygen stage 430 in FIG. 11 is shown after the third brownstock washer to indicate its placement after a batch digester in which no washing would occur in the digester. With a continuous digester, there would be fewer brownstock washers, and the oxygen stage could be earlier in the brownstock system.

The next change is shown by bracket 431. This is a modification of the washer oxygen system of FIG. 11. There should be at least two stages of washing after an oxygen bleach stage. The two washing stages after the oxygen stage at bracket 430 are washer 91''' and decker 121' which is converted to a washer. If the oxygen stage at bracket 430 had been after the second brownstock washer 51' rather than the third brownstock washer 71'', then the oxygen system 431 could have been between washer 91''' and storage tank 110'' as shown in FIG. 11.

In the system shown, the decker 121' has been converted to a washer by the addition of washer heads 125, a process water line 127 and a clean-up washer 124. The system has been further modified into an oxygen system by the addition of an alkali line 425, a steam mixer 426, a steam line 427, an oxygen mixer 428 and an oxygen line 429. These are placed between the decker 121' and the high-density storage tank 140'. The operation is the same as that described for FIG. 11.

The next change is at bracket 432. This shows, in dotted line, the elimination of the chlorine and chlorine dioxide equipment. The chlorine dioxide mixer 144', the chlorine dioxide tower 146', the chlorine aspirator 153', the chlorine mixer 155', the chlorine tower 157', and the pump 159' are eliminated. The piping and chemicals associated with this equipment are also eliminated.

The next change is at bracket 433. This bracket indicates the elimination of the extraction equipment between washers 161' and 181' so that these washers may be used as the two stages of washing after the oxygen stage at bracket 431. This is also indicated by the elements in dotted line. The eliminated items are the steam mixer 166', the extraction tower 173', and the pumps 170', 176', 278' and 282'. Again, the piping and chemical additions required by an extraction stage are also eliminated. The pump 170' may be retained to move the pulp 163' to washer 181' if this is necessary.

The next two changes are shown by brackets 434 and 435. Bracket 434 indicates the elimination of the chlorine dioxide stage and bracket 435 its replacement by a chlorine mixer. The elimination of the chlorine dioxide stage results in the elimination of steam mixer 186', chlorine dioxide mixer 191', chlorine dioxide tower 193', and pumps 190', 196', 298'' and 302'', their associated piping and chemicals. These are replaced by a small chlorine mixer 438 and the chlorine supply line 151'. A chlorine tower is not required. The pump 190' may be retained if it is required to move the pulp 183' to the mixer 430. The chlorine effluent in line 294'''' is maintained separate from the oxygen effluent.

The time in this mixer, as in the oxygen mixer, is less than 1 minute, and normally would be only a few seconds. Pulp traveling at 18.3 meters per second would pass through an 2.4 or 3 meter long reactor in an exceedingly short time. The chlorine would be treated at the temperature of the pulp off the washer, 54° to 60° C., rather than the cooler chlorination temperature.

The last change is shown by bracket 436. This is the oxygen addition to an extraction stage as shown in FIG. 9. The reference numerals and operating conditions are again the same as in FIG. 9.

Each of the gas mixers should be under a back pressure as described earlier.

Figure 13A:
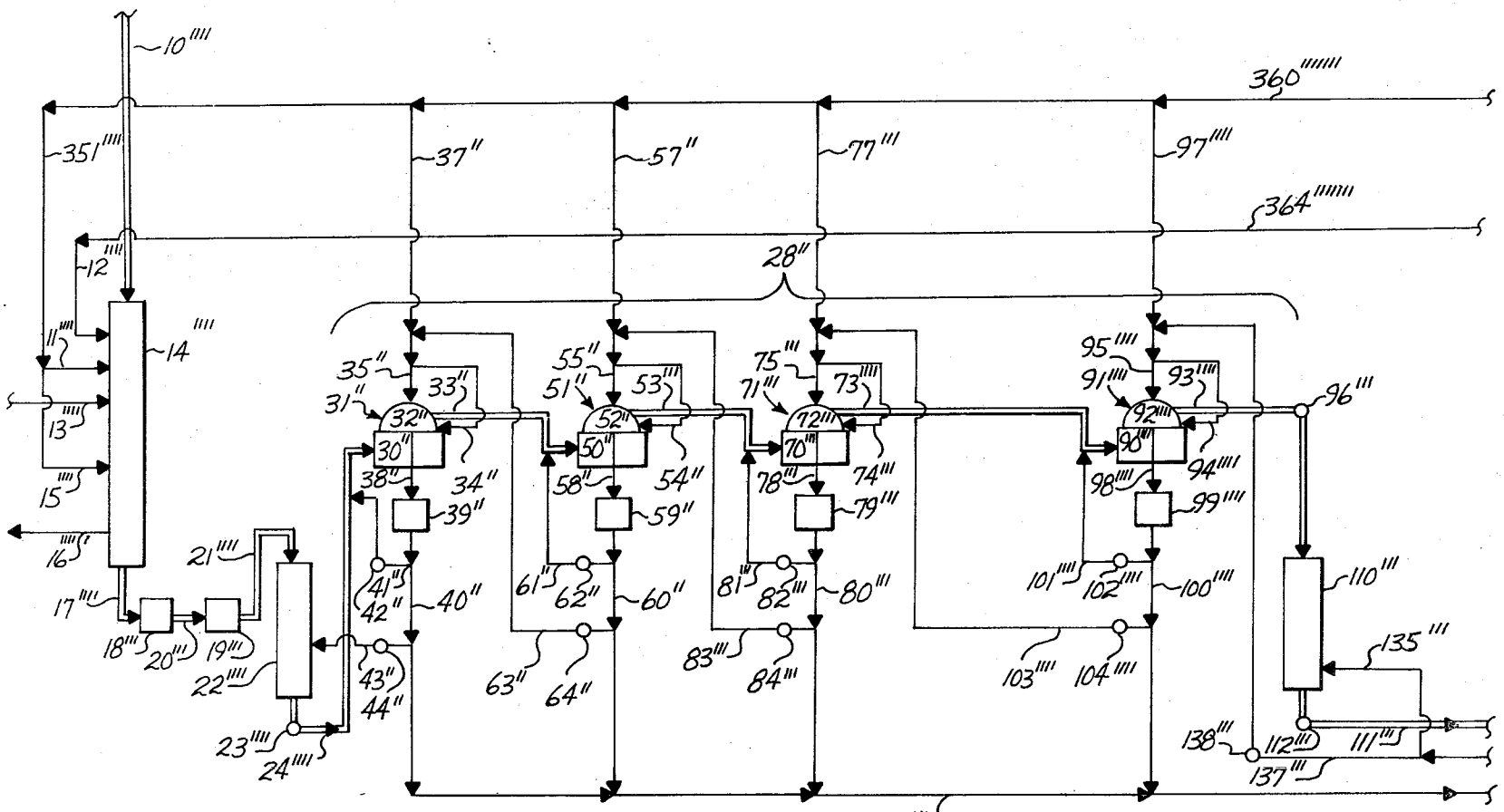
FIGS. 13 (A–C) is a diagram of a pulping and bleaching process using the oxygen bleaching system of FIG. 11, and a modification of FIG. 11.
Figure 13B:
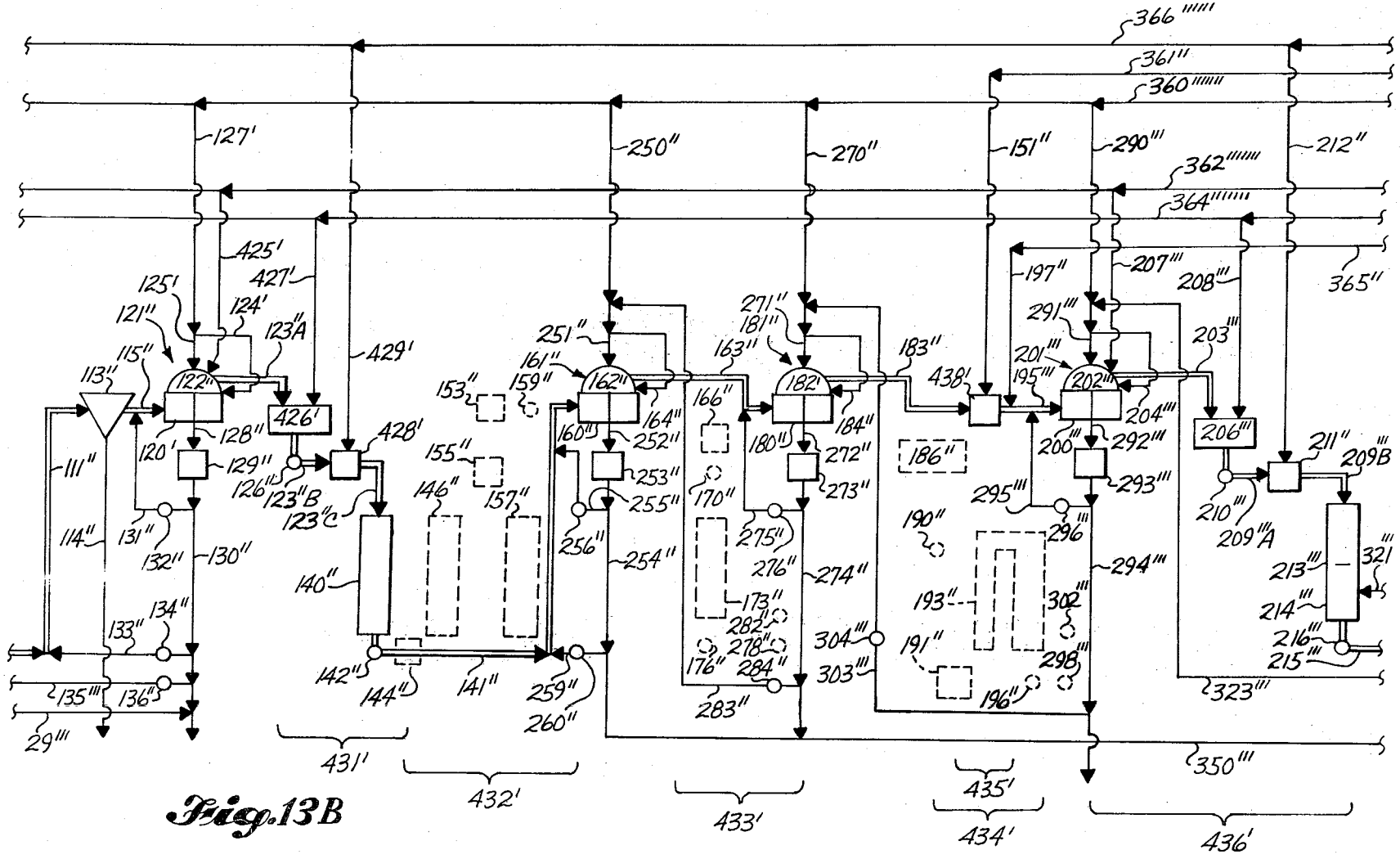
Figure 13C:
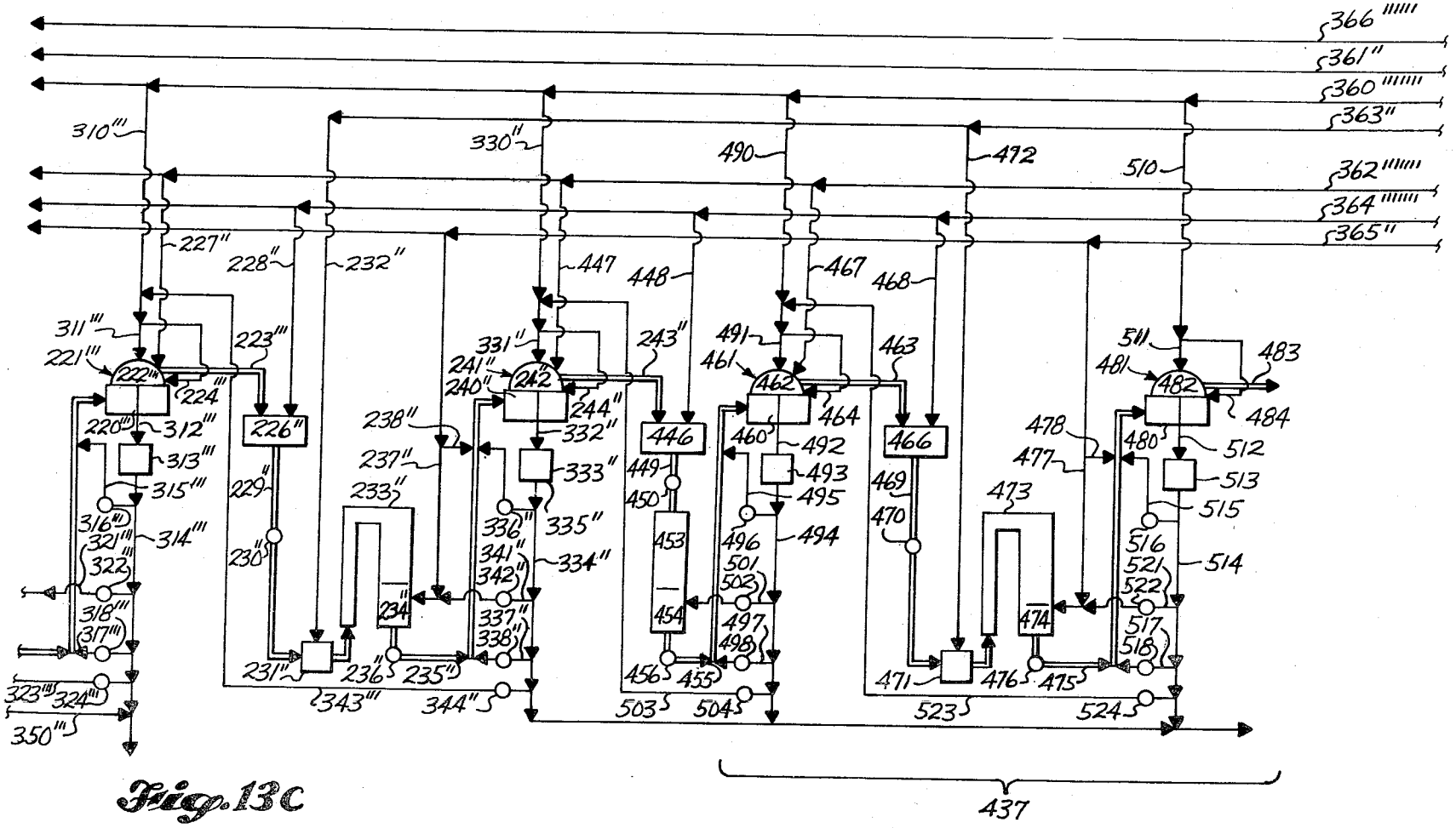

FIG. 13 shows another arrangement in which the bleach sequence is OCODED. Again, the changes between FIG. 13 and FIG. 1 are shown by the brackets in FIG. 13. Changes 431'–436' are the same as those shown in FIG. 12. The same reference numerals and operating conditions are used in FIGS. 1, 12 and 13.

There is one other change indicated by bracket 437. This is the addition of E and D stages at the end of process. Again, the process conditions for this last extraction stage are the same as those for the other extraction stages and for this last chlorine dioxide stage are the same as those for the other chlorine dioxide stages. It should also be realized that the only additional equipment required for these two stages are the two additional washers. The extraction equipment that was eliminated at 433' can be used in this extraction stage and the chlorine dioxide equipment eliminated at 434' can be used in this chlorine dioxide stage. In an actual modification, this equipment would be left in place and repiped.

For the purposes of the present description, however, new reference numerals will be used for these last stages.

In the E stage, the steam mixer is 446, the alkali line 447, the steam line 448, the slurry line 449, the pump 450, the extraction tower 453, the dilution zone 454, the line from the tower to the washer 455 and the pump 456.

In the extraction washer, the vat is 460, the washer 461, the drum 462, the exiting pulp 463, the cleanup washer 464, the incoming process water 490, the washer heads 491, the filtrate line 492, the seal tank 493, the effluent line 494, the dilution lines 495, 497 and 501 and their respective pumps 496, 498 and 502, and the counterflow wash water line 503 and its pump 504.

In the last chlorine dioxide stage, the steam mixer is 466, the alkali line 467, the steam line 468, the pulp slurry line 469, the pump 470, the chlorine dioxide mixer 471, the chlorine dioxide line 472, the chlorine dioxide tower 473, the dilution zone 474, the line from the tower to the washer 475, its pump 476, and the sulfur dioxide lines 477 and 478.

In the last washer, the vat is 480, the washer 481, the drum 482, the exiting pulp 483, the cleanup washer 484, the incoming process water 510, the washer heads 511, the filtrate line 512, the seal tank 513, the effluent line 514, the dilution lines 515, 517 and 521 and their pumps 516, 518 and 522, and the counterflow wash line 523 and its pump 524.

Again, each of the gas mixers should be under a back pressure, as described earlier.

Figure 14:
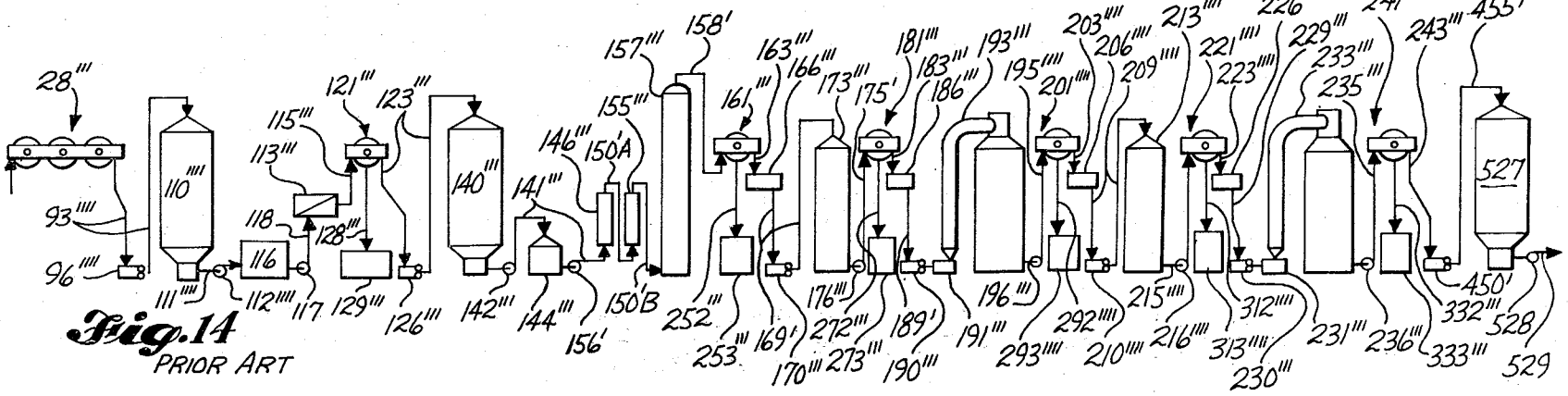
Fig. 14 PRIOR ART
FIG. 14 is another diagram of a prior art bleaching system.
Figure 15:
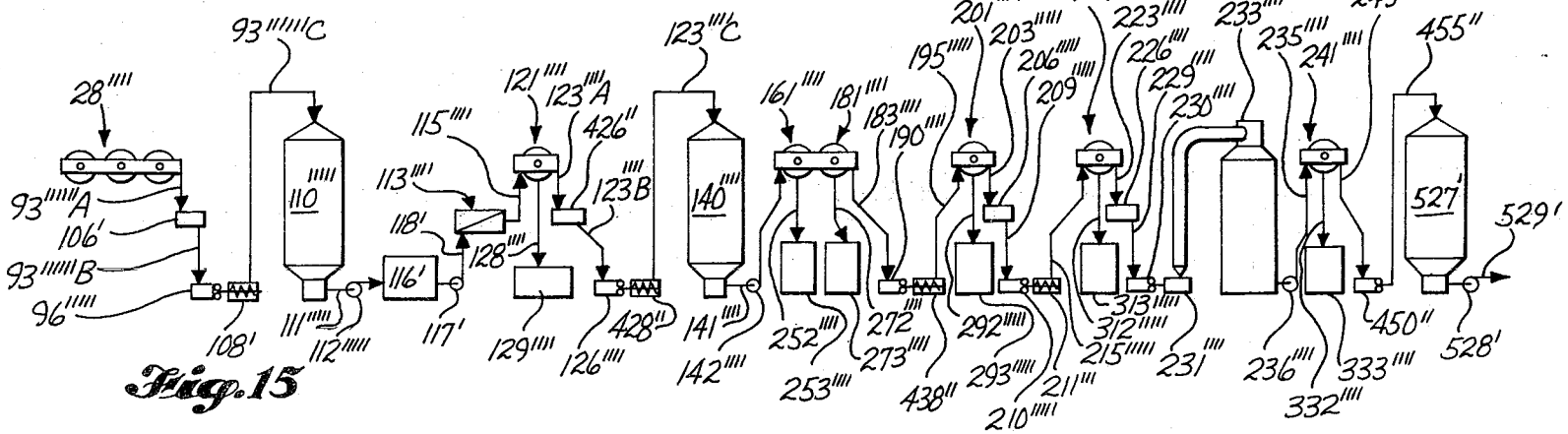
FIG. 15 is a diagram of a pulping and bleaching process using the present systems.
Figure 16:
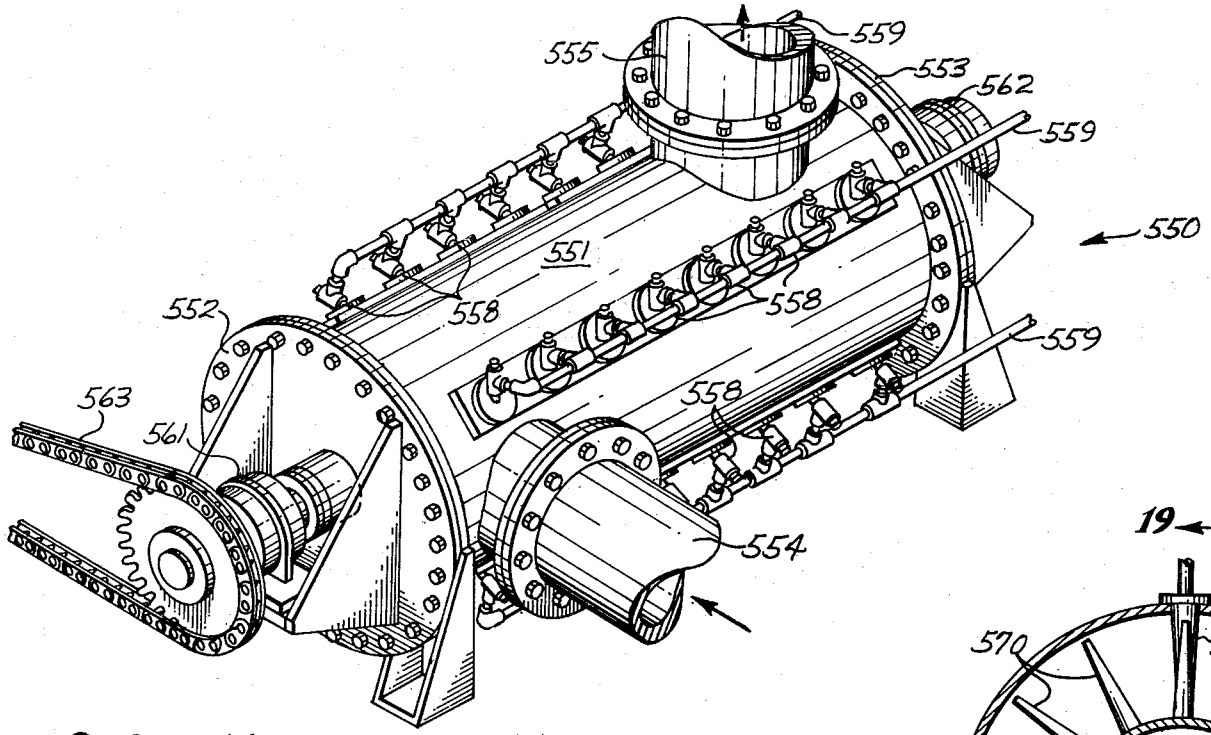
FIG. 16 is an isometric view of a mixer that may be used in the present invention.
Figure 18:
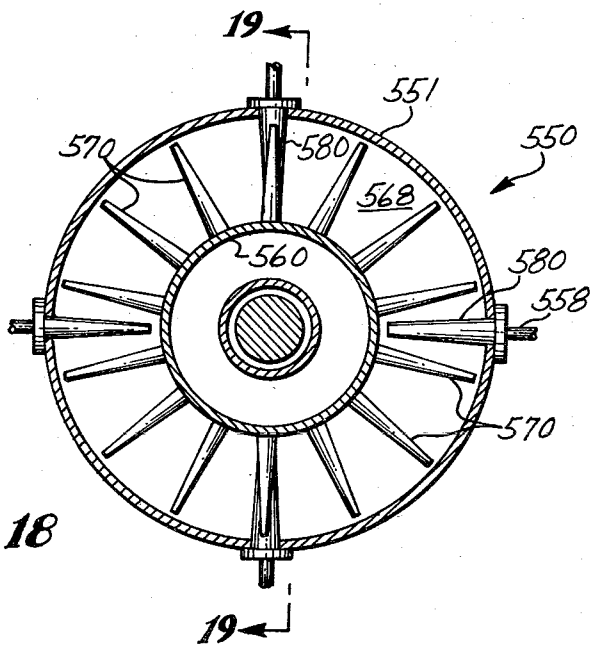
FIG. 18 is a cross section of the mixer taken along line 18—18 of FIG. 17.
Figure 17:
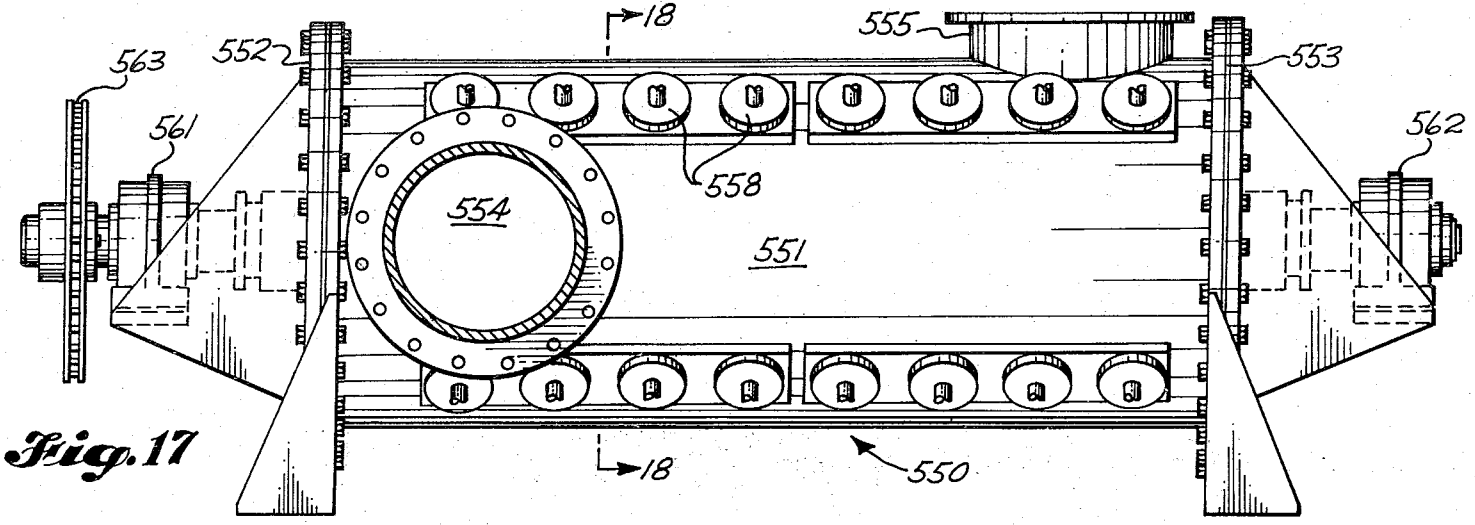
FIG. 17 is a side plan view of the mixer shown in FIG. 16.
Figure 19:
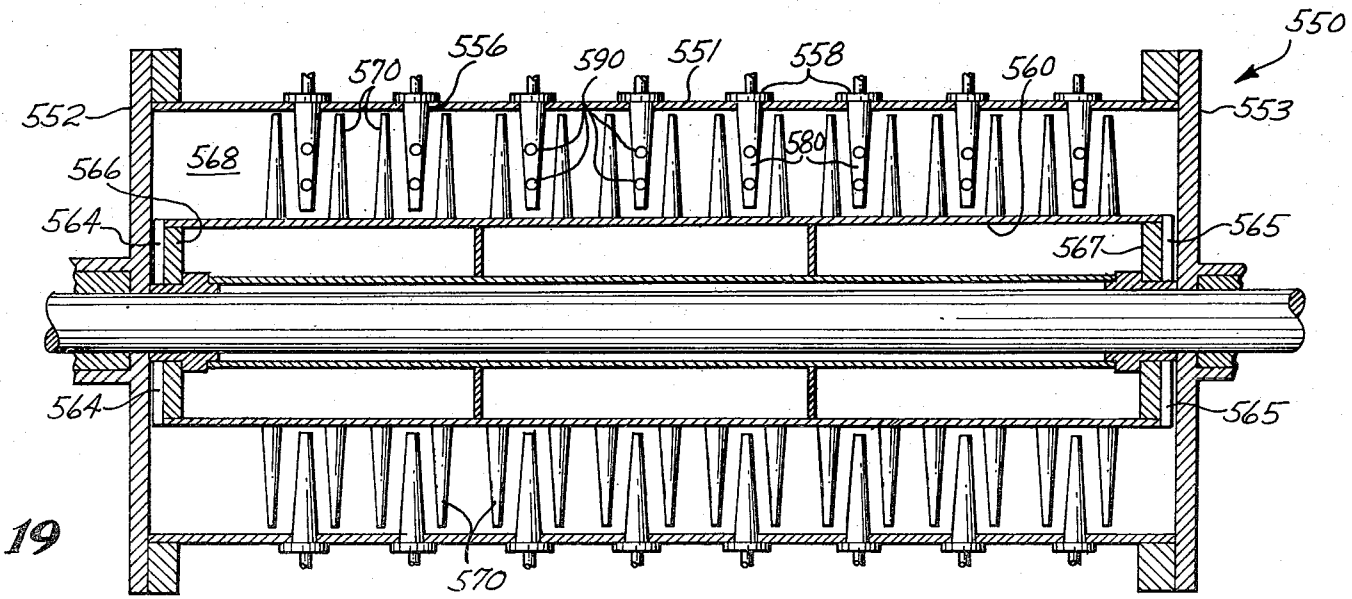
FIG. 19 is a cross section of the mixer taken along line 19—19 of FIG. 18.

The next two FIGS., 14 and 15, illustrate the difference in equipment between a prior art bleach plant having a $D_cEDED$ bleach sequence and a plant using the present system having an OOCOD sequence. Each sequence starts at the brownstock washers and ends at a storage tank. The sequence in FIG. 14 is the same as in FIG. 1—$D_cEDED$. The sequence in FIG. 15 is the same as in FIG. 12—OOCOD. The reference numerals in FIGS. 14 and 15 are the same as those used in FIGS. 1 and 12 and relate to the same pieces of equipment.

In FIG. 14, the pulp 93'''' from brownstock washers 28''' is carried by thick stock pump 96'''' to high-density storage 110''''. From storage, the pulp slurry is moved through line 111'''' by pump 112'''' to a mix tank 116 in which it is mixed with water to reduce its consistency. From tank 116, a pump 117 carries the pulp slurry through line 118 to screens 113'''. Then the pulp slurry 115''' enters decker 121''' where it is dewatered. The filtrate goes through filtrate line 128''' into seal tank 129''', while the pulp 123''' is moved by thick stock pump 126''' to high-density storage 140'''.

From high-density storage 140''', the pulp is moved through line 141''' by pumps 142''' and 156' and mixed with chlorine dioxide in tank 144'''. Thereafter it goes into chlorine dioxide tower 146''' and leaves this tower through line 150'. While in line 150', it is mixed with chlorine in mixer 155''' and carried to chlorine tower 157'''. The chlorinated material leaves the chlorine tower 157''' through line 158' and the extraneous material is washed from it in washer 161'''. The filtrate passes through line 252''' into seal tank 253'''.

The pulp 163''' exits the washer, goes to steam mixer 166''' and is mixed with sodium hydroxide and steam and carried through line 169' by a thick stock pump 170''' to extraction tower 173'''. The alkali in this extraction stage, as in the other, may be added at the washer or the steam mixer. The extracted pulp is moved through line 175' by pump 176''' to washer 181'''. The filtrate from this washing step leaves through line 272''' into seal tank 273'''. The pulp 183''' passes to steam mixer 186''' and again mixed with steam and sodium hydroxide. It then is carried through line 189' by thick stock pump 190''' to chlorine dioxide mixer 191''' and chlorine dioxide tower 193'''. From the chlorine dioxide tower, the pulp slurry is carried through line 195'''' by pump 196''' to washer 201''''. Again, the filtrate from this washer is carried through line 292'''' to seal tank 293'''' while the exiting pulp 203'''' passes to steam mixer 206'''' to be mixed with sodium hydroxide and steam and carried through line 209'''' by thick stock pump 210'''' to extraction tower 213''''.

From the tower, the slurry is carried through line 215'''' by pump 216'''' to washer 221'''' and washed. The filtrate leaves the washer through line 312'''' to seal tank 313'''', while the pulp 223'''' is mixed with steam and possibly sodium hydroxide in steam mixer 226'''. From the mixer, the pulp is carried through line 229''' by thick stock pump 230''' to the chlorine dioxide mixer 231''' and the chlorine dioxide tower 233'''. The pulp slurry is then carried through line 235''' by pump 236''' to washer 241''' where it is again washed. The filtrate passes through line 332''' to seal tank 333'''. The pulp 243''' is carried by thick stock pump 450' through line 455' to storage tank 527. From the storage tank, the material is carried by pump 528 through line 529 to any additional processing.

This should be contrasted with the oxygen system shown in FIG. 15. The eight storage tanks of the prior system become four storage tanks in the present system. This number could be reduced to three because the one chlorine dioxide tower in the system shown in FIG. 15 can also be eliminated. Its purpose is as a storage tank within the system. It need not be used as a chlorine dioxide tower.

In both systems, the material begins with the same PBC and ends with the same PBC. Consequently, this same result is achieved with a great decrease in capital cost in our new system. There are other savings also.

In the system shown in FIG. 15, the pulp 93'''''A from brownstock washers 28'''' is mixed with sodium hydroxide and steam in steam mixer 106' and carried through line 93'''''B by thick stock pump 96'''' to oxygen mixer 108' and thereafter through line 93'''''C to high-density storage tank 110'''''.

From this first oxygen stage, the pulp slurry is carried through line 111''''' by pump 112''''' to tank 116' and from there through line 118' by pump 117' to screens 113''''. From the screens, the pulp 115'''' goes across decker 121''''. The filtrate from the decker is carried through line 128'''' to seal tank 129'''', while the pulp 123''''A is carried to steam mixer 426'', mixed with sodium hydroxide and steam and then carried through line 123''''B by thick stock pump 126'''' to oxygen mixer 428''. From the oxygen mixer, the material passes through line 123''''C to high-density storage 140''''.

The pulp slurry from the high-density storage is carried through line 141'''' by pump 142'''' to washers 161'''' and 181''''. The filtrate from these two washers passes through lines 252'''' and 272'''' to seal tanks 253'''' and 273'''' respectively. The pulp 183'''' from washer 181'''' is carried by thick stock pump 190'''' to chlorine mixer 438''. From the mixer, the slurry passes through line 195''''' to washer 201'''''. The filtrate from this washer passes through line 292''''' to seal tank 293'''''. The pulp 203''''' is carried to steam mixer 206''''', mixed with sodium hydroxide and steam and then carried through line 209''''' by thick stock pump 210''''' to oxygen mixer 211'''. From the oxygen mixer, the pulp passes through line 215''''' to washer 221'''''. The filtrate from this washer passes through line 312''''' to seal tank 313'''''.

The pulp 223''''' from washer 221''''' passes to steam mixer 226'''', is mixed with sodium hydroxide and steam and carried through line 229'''' by thick stock pump 230'''' to chlorine dioxide mixer 231''''. From the mixer, it goes to chlorine dioxide tower 233''''. This tower is optional.

After the tower, the pulp slurry is carried through line 235'''' by pump 236'''' to washer 241''''. The filtrate from this washer passes through line 332'''' to seal tank 333'''' and the pulp 243'''' is moved by thick stock pump 450'' through line 455'' to storage tank 527'. From this tank, it may be moved by pump 528' through line 529' to any subsequent operation.

In these two figures, the sodium hydroxide, or other alkali, may be added either at a washer or at a steam mixer.

The washer after the mixer may be a diffusion washer.

Again there should be a back pressure on the mixer. This pressure is provided in the same way that the pressure is provided to mixer 211, by an upflow line, a pressure valve or a combination of these. The placement of the valve and the maximum pressures are the same as those for mixer 211.

These illustrate OOC and OCO sequences, and are exemplary of O-O-X and O-X-O sequences in general. In either sequence X may be chlorine, chlorine dioxide, combination of chlorine or chlorine dioxide—$C_D$, $D_c$ or mixture of chlorine and chlorine dioxide, hypochlorites, peroxides or ozone. The mixers to be described may be used to mix these. The pulp may be treated with ozone by the treatment described in U.S. Pat. No. 4,216,054 granted Aug. 5, 1980 or U.S. Pat. No. 4,229,252 granted Oct. 21, 1980.

The amount of oxygen and the chemical used will depend, of course, on the K number of the unbleached pulp, the desired brightness and the number of bleach stages. As an example, an OOCOD sequence might use 14 to 20 kilograms of oxygen and 22 to 28 kilograms of sodium hydroxide per metric ton of oven-dry pulp in the first stage; 11 to 17 kilograms of oxygen and 17 to 22 kilograms of sodium hydroxide per metric ton of oven-dry pulp in the second stage; around 56 kilograms of chlorine per metric ton of oven-dry pulp in the third stage; 8 to 11 kilograms of oxygen per metric ton of oven-dry pulp in the fourth stage; and 14 to 16 kilograms of chlorine dioxide per metric ton of oven-dry pulp in the last stage. The temperature of the pulp would not be changed from the temperature of the washer for the chlorine treatment.

The remaining figures show several types of mixer that may be used with these systems. The exterior is the same in each; however, the internal structure does change.

In FIGS. 16–19, the mixer 550 has a cylindrical body 551 and two head plates 552 and 553. The pulp slurry enters through pipe 554, passes through the body of the mixer and exits through pipe 555. The oxygen manifolds 558, which supply oxygen to the stators 580 within the mixer, are supplied by oxygen lines 559.

A shaft 560 extends longitudinally of the mixer and is supported on bearings 561 and 562 and is rotated by rotational means 563. A chain belt drive is shown, but any other type of rotational means may be used.

Figures 20, 21, 22, 23, 35, 36, 37:
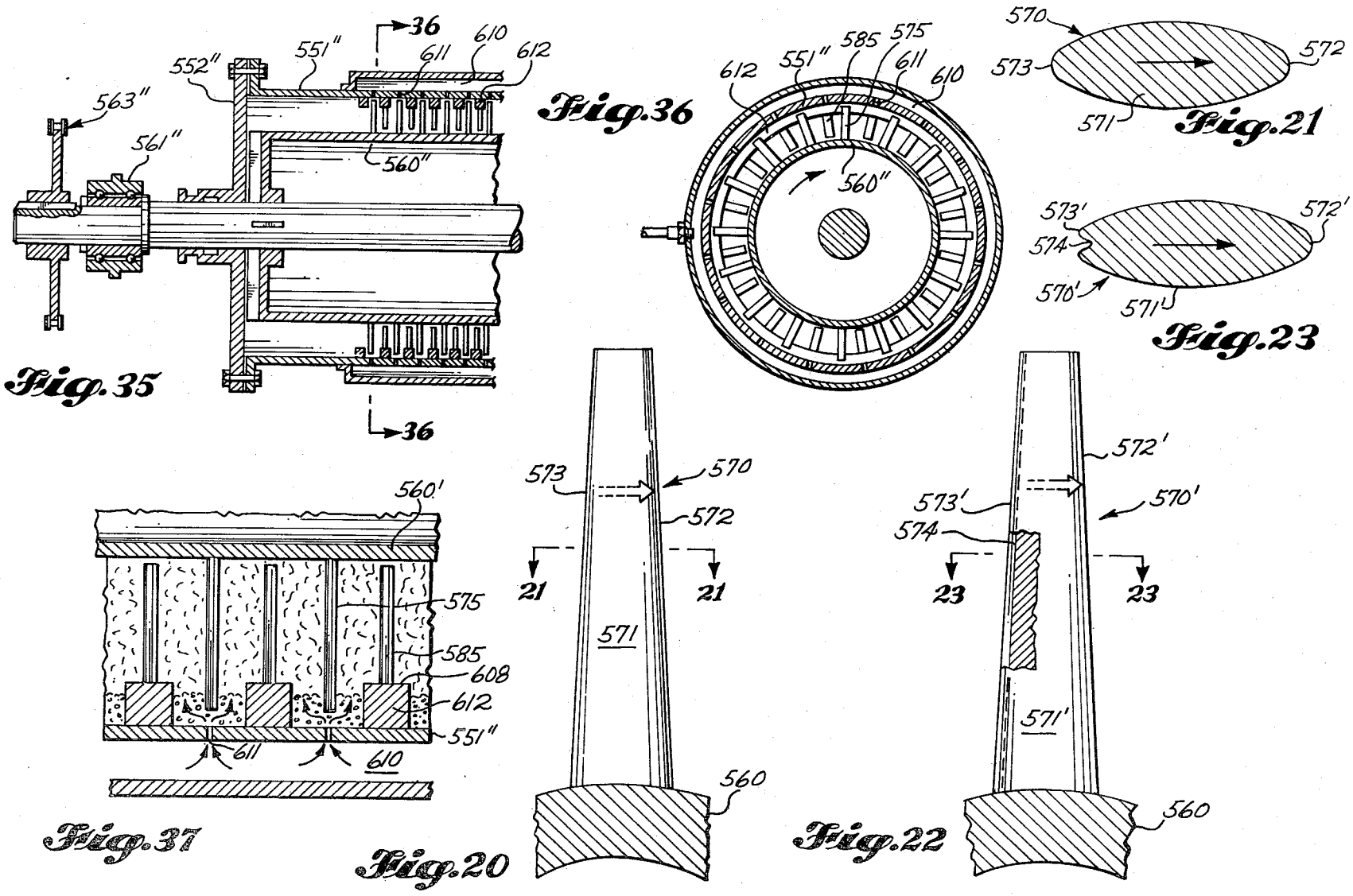
FIG. 20 is a plan view of a rotor.
FIG. 21 is a cross section of the rotor taken along line 21—21 of FIG. 20.
FIG. 22 is a plan view, partially in cross section, of a modified rotor.
FIG. 23 is a cross section of the modified rotor taken along line 23—23 of FIG. 22.
FIG. 35 is a cross section of a modified mixer.
FIG. 36 is a cross section of the modified mixer taken along line 36—36 of FIG. 35.
FIG. 37 is an enlarged cross section of the interior of the mixer shown in FIG. 35.

Rotors 570 are attached to the shaft 560. A typical rotor construction is shown in FIGS. 20–21. The rotor 570 has a body 571 which is tapered outwardly from the shaft and has an elliptically generated cross section. The preferred cross section is an ellipse. The major axis of the rotor is aligned with the direction of rotation of the rotor. Each of its leading and trailing edges 572 and 573 has a radius of the curvature in the range of 0.5 to 15 mm. The radii are usually the same, though they need not be. If different, then the leading edge would have a greater radius than the trailing edge.

A modification is shown in FIGS. 22–23. A groove 574 is formed in the trailing edge 573' of the rotor. The groove is about 0.1 mm across. The groove may be coated with a hydrophobic material.

The number of rotors and the speed of the rotors will depend on the amount of pulp passing through the mixer and the consistency of the pulp passing through the mixer. The area swept by the rotors should be in the range of 10,000 to 1,000,000 square meters per metric ton of oven-dry pulp. The preferred range is 25,000 to 150,000 square meters per metric ton of oven-dry pulp. The optimum is considered to be around 65,400 square meters per metric ton of oven-dry pulp. This area is determined by the formula $$A = \frac{1440\,\pi\,(r_1^2 - r_2^2)\,(R)(N)}{t}$$

where

A = area swept per metric ton, $m^2/t$
$r_1$ = outer radius of the rotor, m
$r_2$ = inner radius of the rotor, m
R = revolutions per minute of the rotor
N = number of rotors
t = metric tons (Oven-Dry Basis) of pulp passing through the mixer per day.

There is a trade-off between the length of the individual rotors and the number of rotors. The rotors are usually arranged in rings on the central shaft. The number of rotors in a ring will depend upon the circumference of the central shaft and the size of the rotor base. A greater number of rotors would require a longer and stiffer shaft. Fewer rotors would require longer rotors. Consequently, space for the mixer would determine the actual rotor configuration. Normally, there are a total of 4 to 400 rotors, and from 2 to 20 rotors in a ring.

The rotors rotate transversely of the direction of pulp movement through the mixer, describing a helical path through the pulp. The speed of rotation of the rotors would be determined by the motor, and the drive ratio between the motor and the central shaft.

The diameter of the central shaft 560 is at least one half of the internal diameter of the mixer, forming an annular space 568 through which the slurry passes.

The enlarged shaft requires scraper bars 564 and 565 on shaft ends 566 and 567. There normally would be four bars on each end. The bars remove fibers that tend to build up between the shaft and the mixer head plate. This prevents binding of the shaft in the mixer.

Figures 24, 25, 26, 27, 32, 33:
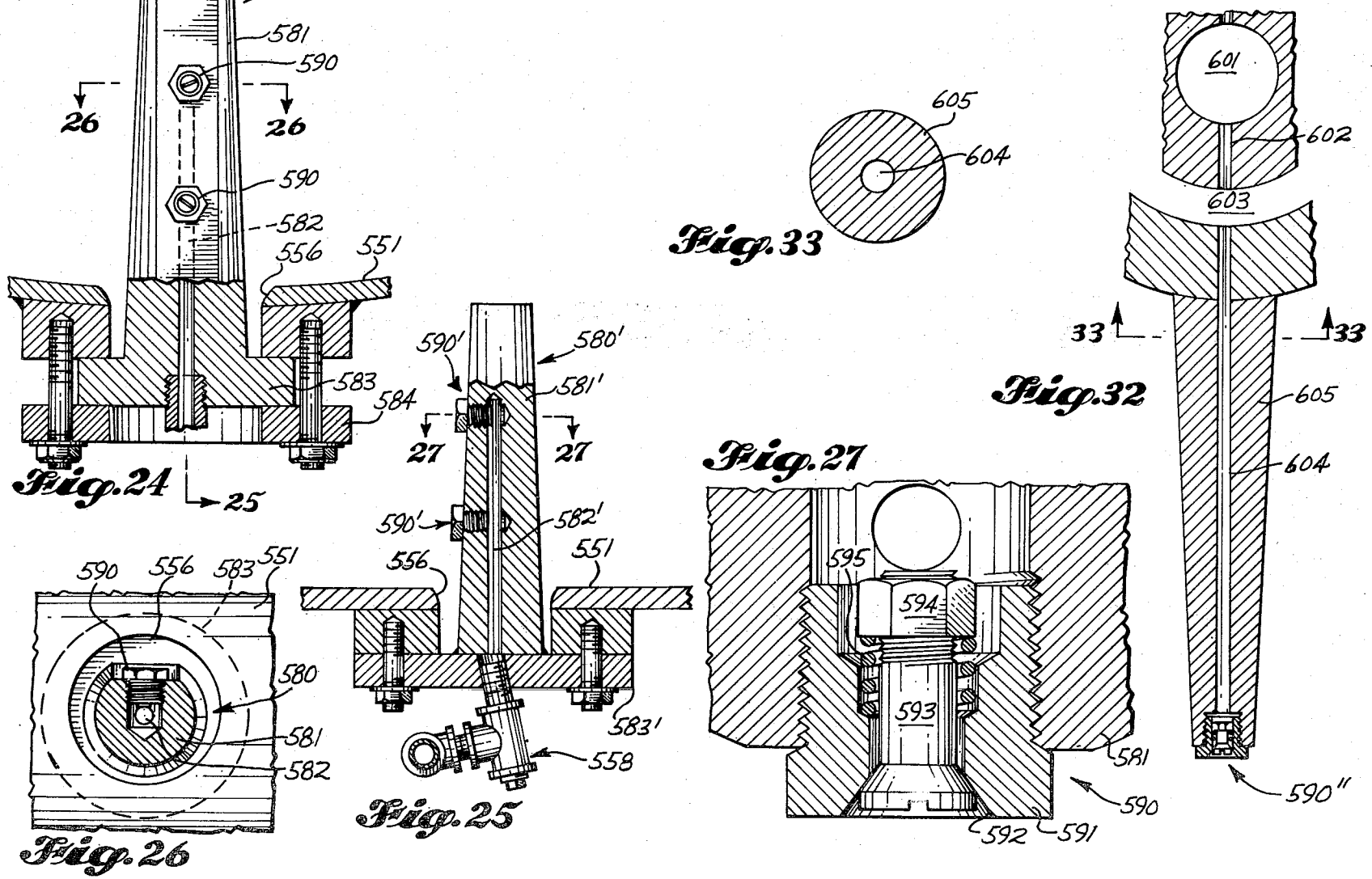
FIG. 24 is a plan view, partially in cross section, of a stator which may be used with the mixer.
FIG. 25 is a side plan view, partially in cross section, of a modified stator taken along a line corresponding to line 25—25 of FIG. 24.
FIG. 26 is a cross section of the stator taken along line 26—26 of FIG. 24.
FIG. 27 is a cross section of a valve taken along line 27—27 of FIG. 25.
FIG. 32 is a cross section of a rotor used in the reactor of FIGS. 28-31.
FIG. 33 is a cross section of the rotor taken along line 33—33 of FIG. 32.
Figures 28, 30:
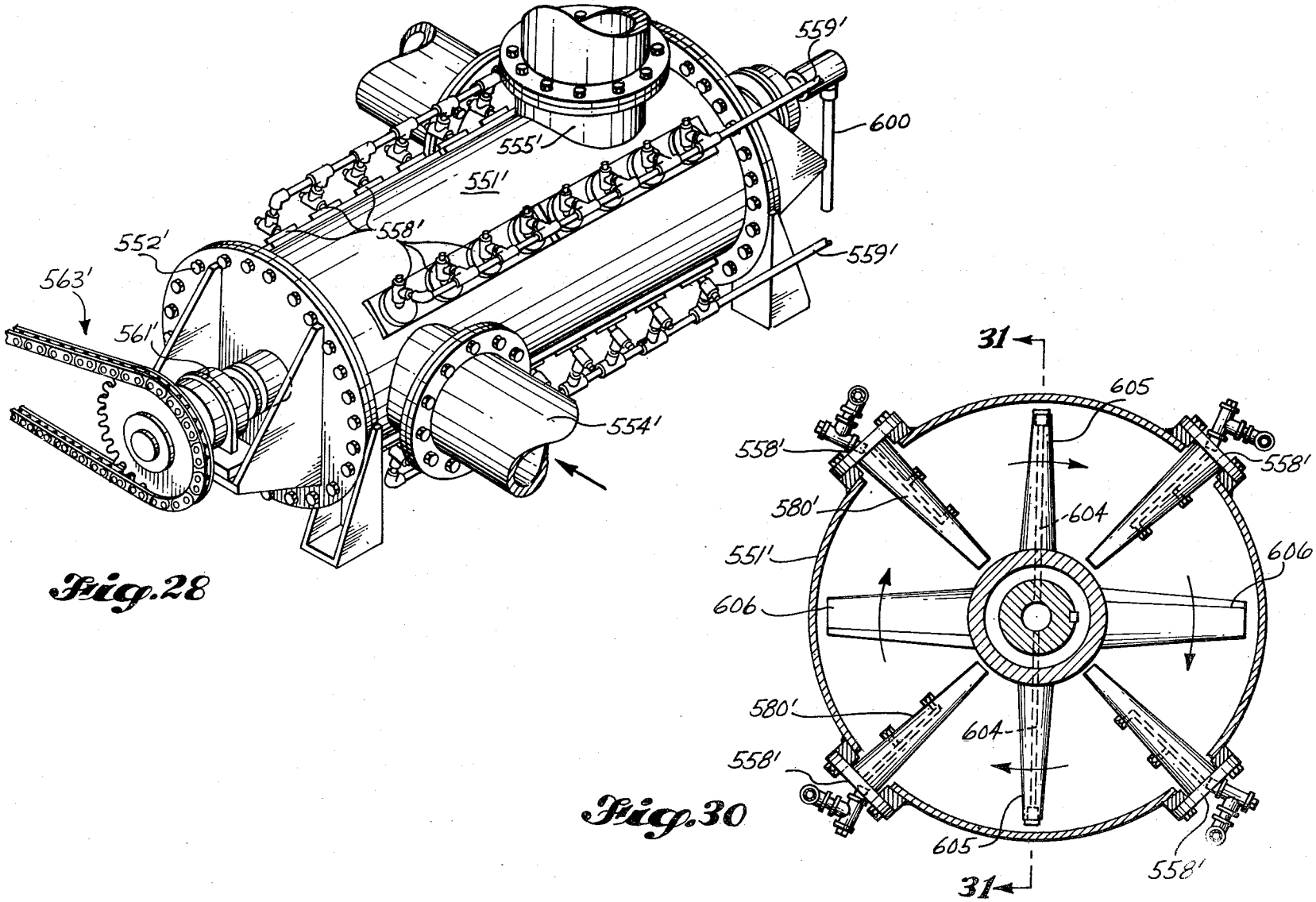
FIG. 28 is an isometric view of a modified mixer.
FIG. 30 is a cross section of the mixer taken along line 30—30 of FIG. 29.
Figure 29:
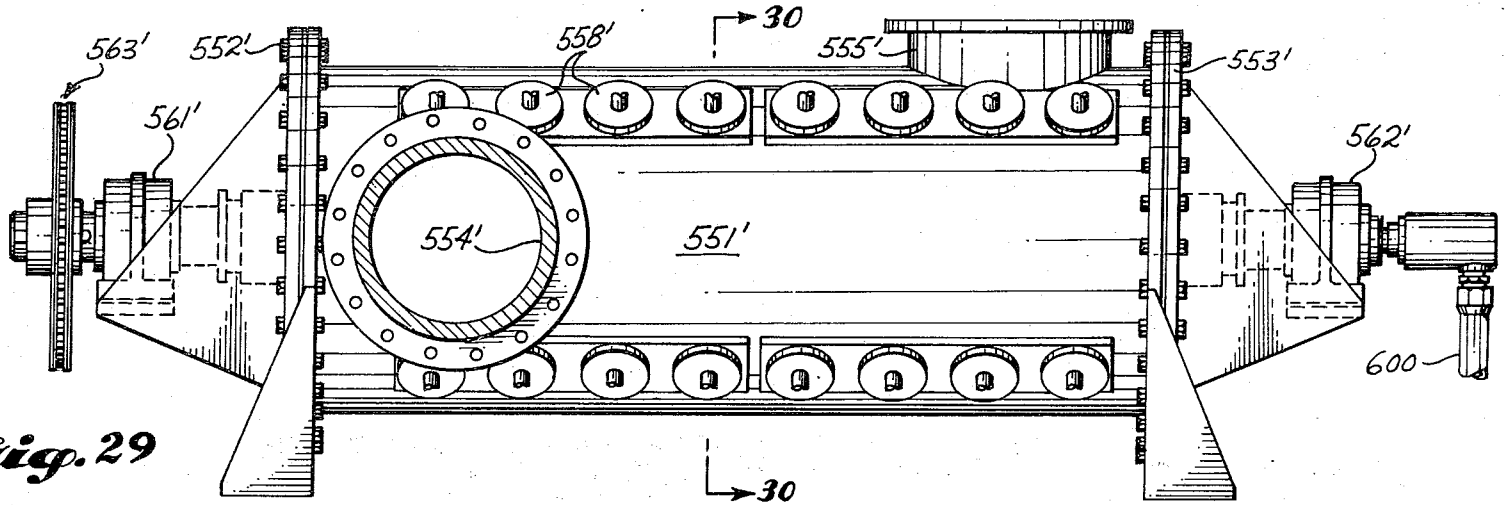
FIG. 29 is a side plan view of the mixer of FIG. 28.
Figure 31:
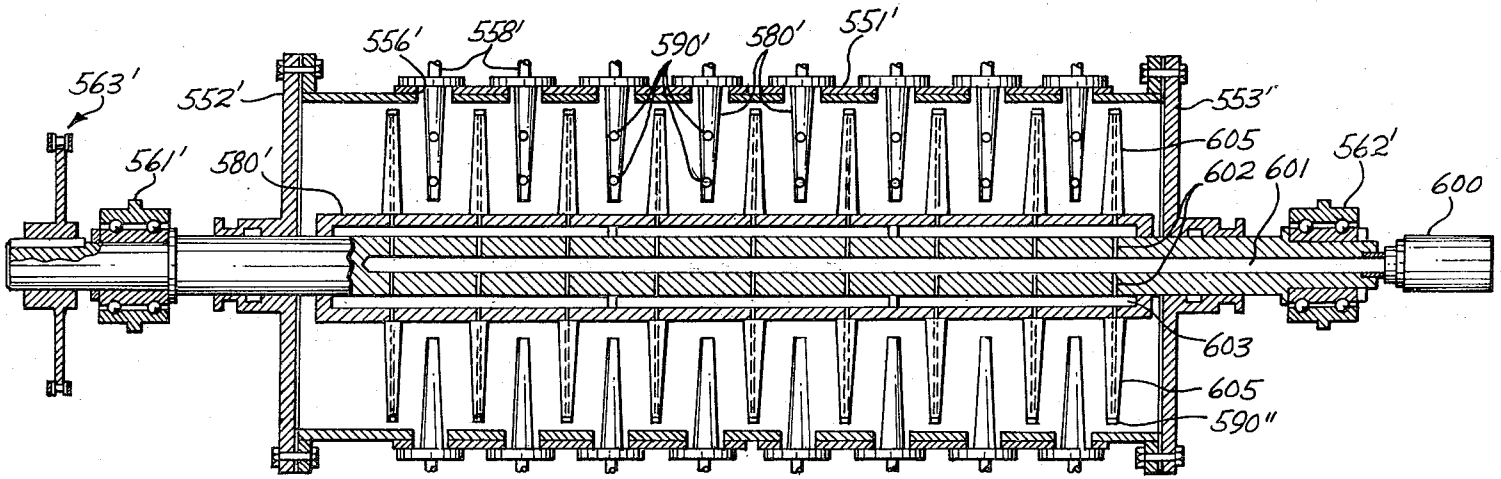
FIG. 31 is a cross section of the mixer taken along line 31—31 of FIG. 30.

The stators are shown in FIGS. 24–26. The stators add oxygen to the pulp in the mixing zone and also act as friction devices to reduce or stop the rotation of the pulp with the rotors so that there is relative rotative movement between the rotors and the pulp. Each stator 580 has a body 581, a central passage 582 and a base plate 583. The stators extend through apertures 556 in body 551. There are two ways of attaching the stators. In FIG. 24, the stator is attached to the body 551 by a friction fit using a Van Stone flange 584. This allows the stator to be rotated if it is desired to change the oxygen placement. In FIG. 25, the base plate 583' is attached directly to the body 551 either by bolts or studs. The oxygen enters the mixer through check valves 590. The stators are round and tapered and the face having the check valves is flattened. The check valves face across a transverse plane of the mixer and in the direction of rotation of the rotors.

The purpose of the check valve 590 is to prevent the pulp fibers from entering the passage 582. A typical check valve is shown in FIG. 27. The valve 590 consists of a valve body 591 which is threaded into stator body 581. The valve body has a valve seat 592. The valve itself consists of a bolt 593 and nut 594 which are biased into a closed position by spring 595.

The number of check valves in a stator may vary from 0 to 4. In some mixers, the major portion of the gas would be added at the mixer entrance, requiring up to 4 check valves, and little or no gas would be added near the mixer outlet, requiring 1 check valve or no check valves, and these stators would then only act as friction drag against pulp rotation. For example, between 60 to 70% of the oxygen could be added in the first half of the mixer. The first one third of the stators would have 3 or 4 check valves, the next one third might have 2 check valves, and the last one third might have 1 or no check valves.

The stators may also be arranged in rings. There should be one ring of stators for each one or two rings of rotors. The number of stators in a ring will depend upon the size of the mixer. Usually, there are 4 stators in a ring, but this can normally vary from 2 to 8.

Both the rotors and the stators should extend across the annular space. A normal clearance between the rotor and the inner wall of the mixer, or the stator and the outer wall of the central shaft is about 13 mm. This ensures that all of the pulp is contacted by the oxygen and there is no short circuiting of the pulp through the mixer without contact with oxygen. The rotors and stators should be between the inlet and outlet to ensure that all the pulp would pass through the swept area, and would be contacted with oxygen.

FIGS. 28–33 disclose a modification to the basic mixer. Oxygen is carried to the rotors through pipe 600 and passage 601 which extends centrally of shaft 560'. Radial passages 602 carry the oxygen to the outer annular manifold 603. The oxygen passes from the manifold to the pulp through central passage 604 of rotor body 605 and through check valve 590''. These valves are the same as valve 590.

The rotor is shown as round and tapered, but its shape may be different. The rotor may be round or square and nontapered such as those normally found in steam mixers. The round rotors would have radii of curvature exceeding 30 mm. Tapered robots 606 having a rectangular cross section may also be used.

Figure 34:
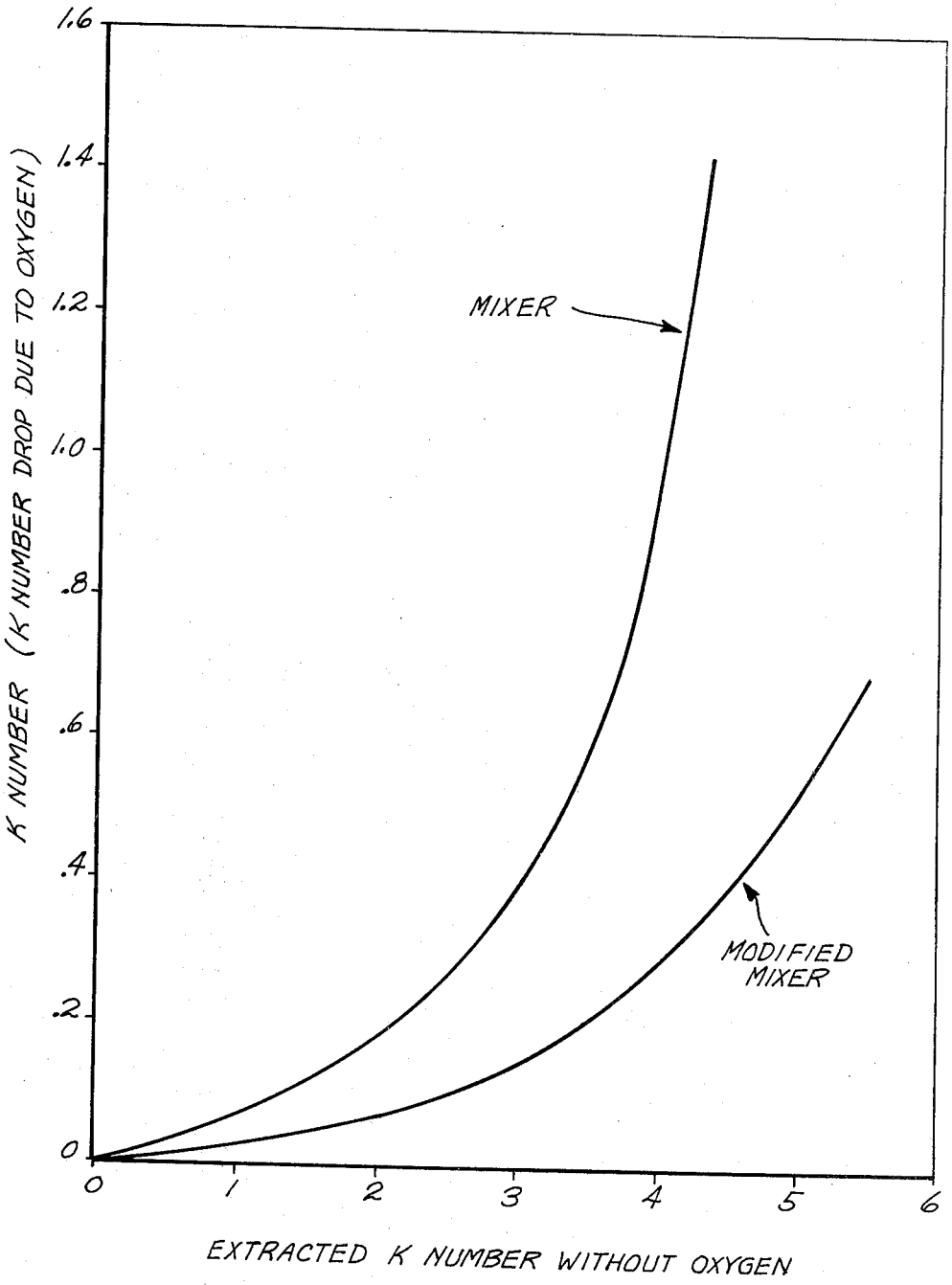
FIG. 34 is a graph comparing two mixers.

FIG. 34 compares the operation of a modified mixer similar to that shown in FIGS. 28–33 with the operation of the mixer of FIGS. 16–27 and indicates the increasing efficacy of the mixer as the swept area is increased and the shaft diameter is expanded. The casing of both mixers was the same. It had an interior diameter of 0.914 m. The inlet and the outlet were the same. In both, the outer radius of the rotor was the same, 0.444 m. Both processed pulp at the same rate, 810 metric tons of oven-dry pulp per day.

The modified mixer had a speed of rotation of 435 RPM. There were 32 stators in 8 rings and 36 rotors in 9 rings. Each ring of rotors had 2 pegs and 2 blades. The blades were rectangular in cross section. The stators and rotor pegs were round, tapered outwardly and 0.254 m long. Oxygen was admitted through the stators only. The diameter of the shaft was 0.38 m and the swept area was 14,100 square meters per metric ton of oven-dry pulp.

The mixer of FIGS. 16–27 had the same internal diameter but had a central shaft that was 0.508 m in diameter. There were 224 rotors. The rotors were elliptical and linealy tapered. The major axis of the rotor extended in the direction of rotation of the rotor. The leading and trailing edges of the rotor had radii of curvature of 3.8 mm. The rotors were 19 cm long and extended to within about 13 mm of the reactor wall, and the stators extended to within about 13 mm of the central shaft. The speed of rotation of the rotors was 435 RPM. The swept area of the reactor was 72,200 square meters per metric ton of oven-dry pulp. Oxygen was admitted through the stators.

FIG. 34 compares the extracted K number of the pulp with the additional K number drop after passing through the mixer, and shows that the mixer achieved a greater K number drop than the modified mixer. It was also found that the mixer needed only half the amount of oxygen as in the modified mixer to obtain the same amount of delignification; that is, with the other operating conditions remaining the same, to achieve the same K number drop, 11 kilograms of oxygen per metric ton of oven-dry pulp were required in the modified mixer, but only 5 kilograms of oxygen per metric ton of oven-dry pulp were required in the mixer. It was also found that the mixer could mix greater amounts of oxygen with the pulp than the modified mixer. Between $1\frac{1}{2}$ to 2 times as much oxygen could be mixed with the pulp with the mixer than with the modified mixer. For example, the modified mixer could mix a maximum of 15.1–20.2 kilograms of oxygen with a metric ton of oven-dry pulp. The mixer could mix 30.2–35.3 kilograms of oxygen with a metric ton of oven-dry pulp.

The optimum swept area is achieved by reducing the number of rotors in the mixer from 224 to 203.

FIGS. 35–37 illustrate a different type of rotor and stator arrangement and a different type of oxygen admission.

In this modification, an oxygen manifold 610 surrounds the outer body 551'' of the mixer and the gas enters the mixer through holes 611 in body 551''. An annular dam 612, located between each ring of holes 611, is attached to the inner wall of body 551''. The dams 612 create a pool of gas adjacent the mixer wall. The stators 585 are attached to the dams 612. The rotors 575 are aligned with the spaces between the dams 612. The outer radius of the rotors 575 is greater than the inner radius of the dams 612 so that the rotors extend beyond the inner wall 608 of the dam into the trapped gas between the dams. This construction allows the rotor to extend into a gas pocket and for the gas to flow down the trailing edge of the rotor as it passes through the pulp slurry.

The rotors and stators may be flat with rounded leading and trailing edges. Again, the radius of curvature of the leading and trailing edges would be in the range of 0.5 to 15 mm, and the radii need not be the same. The rotors and stators may be as narrow as 6.35 mm in width.

This design could also include the groove in the trailing edge of the rotor which may be covered with a hydrophobic coating.

In the claims the term "combination of chlorine and chlorine dioxide" includes $D_c$, $C_D$ and mixtures of chlorine and chlorine dioxide.

What is claimed is:

1. The process of bleaching pulp comprising treating pulp at a consistency of 7 to 15% with oxygen at an alkaline pH and a temperature of around 65° C. to around 121° C., washing said oxygen treated pulp, treating said washed pulp with a bleaching chemical selected from a group consisting of chlorine, chlorine dioxide, combinations of chlorine and chlorine dioxide, hypochlorites, peroxides and ozone, washing said bleaching chemical treated pulp, and treating said latter washed pulp at a consistency of 7 to 15% with oxygen at an alkaline pH and a temperature of around 65° C. to around 121° C., said oxygen in each of said oxygen treatments being mixed with said pulp in a mixing zone in which a plurality of rotating members pass through said pulp in a direction transverse the direction of travel of said pulp, said members having a major axis extending in the direction of rotation, said members providing a swept area through said pulp of 10,000 to 1,000,000 square meters per metric ton of oven dry pulp, said members having leading and trailing edges, said leading edge having a radius of curvature in the range of 0.5 to 15 mm.

2. The process of claim 1 in which in each of said oxygen mixings said swept area is 14,100 to 1,000,000 square meters per metric ton of oven dry pulp.

3. The process of claim 1 in which in each of said oxygen mixings said swept area is 25,000 to 150,000 square meters per metric ton of oven dry pulp.

4. The process of claim 1 in which in each of said oxygen mixings said swept area is around 65,400 square meters per metric ton of oven dry pulp.

5. The process of claims 1, 2, 3 or 4 in which said members have elliptically generated cross sections having a major axis extending in the direction of rotation.

6. The process of claims 1, 2, 3 or 4 in which each of said oxygen mixings occurs in an annular space in which the interior surface of said space has a radius of at least one half of the radius of the exterior surface of said space.

7. The process of claims 1, 2, 3 or 4 in which said trailing edge has a radius of curvature in the range of 0.5 to 15 mm.

8. The process of claims 1, 2, 3 or 4 in which in each of said oxygen mixings said oxygen is added incrementally to said pulp.

9. The process of claims 1, 2, 3 or 4 in which in each of said oxygen mixings mixing takes place under a pressure of up to 830 kPa gage.

10. The process of claims 1, 2, 3 or 4 in which prior to each of said oxygen mixings said pulp is heated to said temperature of around 65° C. to around 121° C. in said oxygen mixing.

11. The process of claim 1 in which said first oxygen treatment is preceded by a treatment of said pulp at a consistency of 8 to 15% with oxygen at an alkaline pH and a temperature of around 65° C. to around 121° C., and washing said oxygen pretreated pulp, said oxygen being mixed with said pulp in a mixing zone in which a plurality of rotating members pass through said pulp in a direction transverse the direction of travel of said pulp, said members having a major axis extending in the direction of rotation, said members providing a swept area through said pulp of 10,000 to 1,000,000 square meters per metric ton of oven dry pulp, said members having leading and trailing edges, said leading edge having a radius of curvature in the range of 0.5 to 15 mm.

12. The process of claim 11 in which in each of said oxygen mixings said swept area is 14,100 to 1,000,000 square meters per metric ton of oven dry pulp.

13. The process of claim 11 in which in each of said oxygen mixings said swept area is 25,000 to 150,000 square meters per metric ton of oven dry pulp.

14. The process of claim 11 in which in each of said oxygen mixings said swept area is around 65,400 square meters per metric ton of oven dry pulp.

15. The process of claims 11, 12, 13 or 14 in which said members have elliptically generated cross sections having a major axis extending in the direction of rotation.

16. The process of claims 11, 12, 13 or 14 in which each of said oxygen mixings occurs in an annular space in which the interior surface of said space has a radius of at least one half of the radius of the exterior surface of said space.

17. The process of claims 11, 12, 13 or 14 in which said trailing edge has a radius of curvature in the range of 0.5 to 15 mm.

18. The process of claims 11, 12, 13 or 14 in which in each of said oxygen mixings said oxygen is added incrementally to said pulp.

19. The process of claims 11, 12, 13 or 14 in which in each of said oxygen mixings said mixing takes place under a pressure of up to 830 kPa gage.

20. The process of claims 11, 12, 13 or 14 in which prior to each of said oxygen mixings said pulp is heated to said temperature of around 65° C. to around 121° C. in said oxygen mixing.

21. The process of claim 1 further comprising prior to each of said oxygen mixings adjusting said pulp to said consistency of 7 to 15%.

22. The process of claim 21 in which in each of said oxygen mixings said swept area is 14,100 to 1,000,000 square meters per metric ton of oven dry pulp.

23. The process of claim 21 in which in each of said oxygen mixings said swept area is 25,000 to 150,000 square meters per metric ton of oven dry pulp.

24. The process of claim 21 in which in each of said oxygen mixings said swept area is around 65,400 square meters per metric ton of oven dry pulp.

25. The process of claims 21, 22, 23 or 24 in which said members have elliptically generated cross sections having a major axis extending in the direction of rotation.

26. The process of claims 21, 22, 23 or 24 in which each of said oxygen mixings occurs in an annular space in which the interior surface of said space has a radius of at least one half of the radius of the exterior surface of said space.

27. The process of claims 21, 22, 23 or 24 in which said trailing edge has a radius of curvature in the range of 0.5 to 15 mm.

28. The process of claims 21, 22, 23 or 24 in which in each of said oxygen mixings said oxygen is added incrementally to said pulp.

29. The process of claims 21, 22, 23 or 24 in which in each of said oxygen mixings said mixing takes place under a pressure of up to 830 kPa gage.

30. The process of claims 21, 22, 23 or 24 in which prior to each of said oxygen mixings said pulp is heated to said temperature of around 65° C. to around 121° C. in said oxygen mixing.

31. The process of claim 21 in which said first oxygen treatment is preceded by a treatment of said pulp at a consistency of 8 to 15% with oxygen at an alkaline pH and a temperature of around 65° C. to around 121° C., and washing said oxygen pretreated pulp, said oxygen being mixed with said pulp in a mixing zone in which a plurality of rotating members pass through said pulp in a direction transverse the direction of travel of said pulp, said members having a major axis extending in the direction of rotation, said members providing a swept area through said pulp of 10,000 to 1,000,000 square meters per metric ton of oven dry pulp, said members having leading and trailing edges, said leading edge having a radius of curvature in the range of 0.5 to 15 mm.

32. The process of claim 31 in which in each of said oxygen mixings said swept area is 14,100 to 1,000,000 square meters per metric ton of oven dry pulp.

33. The process of claim 31 in which in each of said oxygen mixings said swept area is 25,000 to 150,000 square meters per metric ton of oven dry pulp.

34. The process of claim 31 in which in each of said oxygen mixings said swept area is around 65,400 square meters per metric ton of oven dry pulp.

35. The process of claims 31, 32, 33 or 34 in which said members have elliptically generated cross sections having a major axis extending in the direction of rotation.

36. The process of claims 31, 32, 33 or 34 in which each of said oxygen mixings occurs in an annular space in which the interior surface of said space has a radius of at least one half of the radius of the exterior surface of said space.

37. The process of claims 31, 32, 33 or 34 in which said trailing edge has a radius of curvature in the range of 0.5 to 15 mm.

38. The process of claims 31, 32, 33 or 34 in which in each of said oxygen mixings said oxygen is added incrementally to said pulp.

39. The process of claims 31, 32, 33 or 34 in which in each of said oxygen mixings said mixing takes place under a pressure of up to 830 kPa gage.

40. The process of claims 31, 32, 33 or 34 in which prior to each of said oxygen mixings said pulp is heated to said temperature of around 65° C. to around 121° C. in said oxygen mixing.

41. A pulping apparatus comprising first means for adding a pH adjustment chemical to pulp, second means after said first means for adding oxygen to said pulp, third means for mixing said oxygen with said pulp, fourth means after said third means for washing said oxygen treated pulp, fifth means after said fourth means for adding a chemical selected from the group consisting of chlorine, chlorine dioxide, a combination of chlorine and chlorine dioxide, hypochlorite, peroxide and ozone to said pulp, sixth means for mixing said latter chemical with said pulp, seventh means after said sixth means for washing said pulp, eighth means after said seventh means for adding a pH adjustment chemical to said pulp, ninth means after said eighth means for adding oxygen to said pulp, tenth means for mixing said oxygen with said pulp, eleventh means for transporting said pulp from said first through tenth means, each of said oxygen mixing means having a mixing zone, a plurality or rotors in said mixing zone, said rotors having leading and trailing edges, said leading edge having a radius of curvature in the range of 0.5 to 15 mm, said rotors having a major axis extending in the direction of rotation, said rotors being rotatable through said pulp in a direction transverse to the direction of travel of said pulp, means for rotating said rotors, and said rotors providing a swept area of 10,000 to 1,000,000 square meters per metric ton of oven dry pulp.

42. The apparatus of claim 41 in which said rotors provide a swept area of 14,100 to 1,000,000 square meters per metric ton of oven dry pulp.

43. The apparatus of claim 41 in which said rotors provide a swept area of 25,000 to 150,000 square meters per metric ton of oven dry pulp.

44. The apparatus of claim 41 in which said rotors provide a swept area of around 65,400 square meters per metric ton of oven dry pulp.

45. The apparatus of claims 41, 42, 43 or 44 in which said rotors have elliptically generated cross sections having a major axis extending in the direction of rotation.

46. The apparatus of claims 41, 42, 43 or 44 in which said mixing zone is an annular space in which the interior surface of said space has a radius of at least one-half of the radius of the exterior surface of said space.

47. The apparatus of claims 41, 42, 43 or 44 in which said trailing edge has a radius of curvature in the range of 0.5 to 15 mm.

48. The apparatus of claims 41, 42, 43 or 44 further comprising a plurality of stators extending into said mixing zone, at least some of said stators having a first passage extending from outside of said mixing zone lengthwise through said stator and a second passage communicating between said first passage and said mixing zone, and a check valve in said second passage.

49. The apparatus of claims 41, 42, 43 or 44 further comprising means, prior to each of said oxygen mixing means, for heating said pulp so that it will be at a temperature in the range of around 65° C. to around 121° C. in said mixing means.

50. The apparatus of claim 41 further comprising first additional means for adding a pH adjustment chemical to said pulp, second additional means after said first additional means for adding oxygen to said pulp, third additional means for mixing said oxygen with said pulp, and fourth additional means after said third additional means and prior to said first means for washing said pulp, said oxygen mixing means having a mixing zone, a plurality or rotors in said mixing zone, said rotors having leading and trailing edges, said leading edge having a radius of curvature in the range of 0.5 to 15 mm, said rotors having a major axis extending in the direction of rotation, said rotors being rotatable through said pulp in a direction transverse to the direction of travel of said pulp, means for rotating said rotors, and said rotors providing a swept area of 10,000 to 1,000,000 square meters per metric ton of oven dry pulp.

51. The apparatus of claim 50 in which said rotors provide a swept area of 14,100 to 1,000,000 square meters per metric ton of oven dry pulp.

52. The apparatus of claim 50 in which said rotors provide a swept area of 25,000 to 150,000 square meters per metric ton of oven dry pulp.

53. The apparatus of claim 50 in which said rotors provide a swept area of around 65,400 square meters per metric ton of oven dry pulp.

54. The apparatus of claims 50, 51, 52 or 53 in which said rotors have elliptically generated cross sections having a major axis extending in the direction of rotation.

55. The apparatus of claims 50, 51, 52 or 53 in which said mixing zone is an annular space in which the interior surface of said space has a radius of at least one-half of the radius of the exterior surface of said space.

56. The apparatus of claims 50, 51, 52 or 53 in which said trailing edge has a radius of curvature in the range of 0.5 to 15 mm.

57. The apparatus of claims 50, 51, 52 or 53 further comprising a plurality of stators extending into said mixing zone, at least some of said stators having a first passage extending from outside of said mixing zone lengthwise through said stator and a second passage communicating between said first passage and said mixing zone, and a check valve in said second passage.

58. The apparatus of claims 50, 51, 52 or 53 further comprising means, prior to each of said oxygen mixing means, for heating said pulp so that it will be at a temperature in the range of around 65° C. to around 121° C. in said mixing means.

59. The apparatus of claim 41 further comprising means, prior to each of said oxygen mixing means, for adjusting the consistency of said pulp to 7 to 15%.

60. The apparatus of claim 59 in which said rotors provide a swept area of 14,100 to 1,000,000 square meters per metric ton of oven dry pulp.

61. The apparatus of claim 59 in which said rotors provide a swept area of 25,000 to 150,000 square meters per metric ton of oven dry pulp.

62. The apparatus of claim 59 in which said rotors provide a swept area of around 65,400 square meters per metric ton of oven dry pulp.

63. The apparatus of claims 59, 60, 61 or 62 in which said rotors have elliptically generated cross sections having a major axis extending in the direction of rotation.

64. The apparatus of claims 59, 60, 61 or 62 in which said mixing zone is an annular space in which the interior surface of said space has a radius of at least one-half of the radius of the exterior surface of said space.

65. The apparatus of claims 59, 60, 61 or 62 in which said trailing edge has a radius of curvature in the range of 0.5 to 15 mm.

66. The apparatus of claims 59, 60, 61 or 62 further comprising a plurality of stators extending into said mixing zone, at least some of said stators having a first passage extending from outside of said mixing zone lengthwise through said stator and a second passage communicating between said first passage and said mixing zone, and a check valve in said second passage.

67. The apparatus of claims 59, 60, 61 or 62 further comprising means, prior to each of said oxygen mixing means, for heating said pulp so that it will be at a temperature in the range of around 65° C. to around 121° C. in said mixing means.

68. The apparatus of claim 59 further comprising first additional means for adding a pH adjustment chemical to said pulp, second additional means after said first additional means for adding oxygen to said pulp, third additional means for mixing said oxygen with said pulp, and fourth additional means after said third additional means and prior to said first means for washing said pulp, said oxygen mixing means having a mixing zone, a plurality or rotors in said mixing zone, said rotors having leading and trailing edges, said leading edge having a radius of curvature in the range of 0.5 to 15 mm, said rotors having a major axis extending in the direction of rotation, said rotors being rotatable through said pulp in a direction transverse to the direction of travel of said pulp, means for rotating said rotors, and said rotors providing a swept area of 10,000 to 1,000,000 square meters per metric ton of oven dry pulp.

69. The apparatus of claim 68 in which said rotors provide a swept area of 14,100 to 1,000,000 square meters per metric ton of oven dry pulp.

70. The apparatus of claim 68 in which said rotors provide a swept area of 25,000 to 150,000 square meters per metric ton of oven dry pulp.

71. The apparatus of claim 68 in which said rotors provide a swept area of around 65,400 square meters per metric ton of oven dry pulp.

72. The apparatus of claims 68, 69, 70 or 71 in which said rotors have elliptically generated cross sections having a major axis extending in the direction of rotation.

73. The apparatus of claims 68, 69, 70 or 71 in which said mixing zone is an annular space in which the interior surface of said space has a radius of at least one-half of the radius of the exterior surface of said space.

74. The apparatus of claims 68, 69, 70 or 71 in which said trailing edge has a radius of curvature in the range of 0.5 to 15 mm.

75. The apparatus of claims 68, 69, 70 or 71 further comprising a plurality of stators extending into said mixing zone, at least some of said stators having a first passage extending from outside of said mixing zone lengthwise through said stator and a second passage communicating between said first passage and said mixing zone, and a check valve in said second passage.

76. The apparatus of claims 68, 69, 70 or 71 further comprising means, prior to each of said oxygen mixing means, for heating said pulp so that it will be at a temperature in the range of around 65° C. to around 121° C. in said mixing means.

77. The apparatus of claims 50, 51, 52 or 53 further comprising a valve in said transportation means after of each of said oxygen mixing means.

78. The apparatus of claims 59, 60, 61 or 62 further comprising a valve in said transportation means after of each of said oxygen mixing means.

79. The apparatus of claims 68, 69, 70 or 71 further comprising a valve in said transportation means after of each of said oxygen mixing means.

* * * * *